US010052868B1

(12) United States Patent
Tunmore

(10) Patent No.: US 10,052,868 B1
(45) **Date of Patent: *Aug. 21, 2018**

(54) MODULAR PRINTHEAD ASSEMBLY WITH RAIL ASSEMBLY HAVING UPSTREAM AND DOWNSTREAM ROD SEGMENTS

(71) Applicant: Eastman Kodak Company, Rochester, NY (US)

(72) Inventor: David F. Tunmore, Xenia, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/590,070

(22) Filed: May 9, 2017

(51) Int. Cl.

| | |
|---|---|
| ***B41J 25/34*** | (2006.01) |
| ***B41J 25/00*** | (2006.01) |
| ***B41J 2/045*** | (2006.01) |
| ***B41J 2/03*** | (2006.01) |
| ***B41J 2/02*** | (2006.01) |

(52) U.S. Cl.
CPC ..... *B41J 2/04505* (2013.01); *B41J 2/02* (2013.01); *B41J 2/03* (2013.01)

(58) Field of Classification Search
CPC . B41J 2/09; B41J 2/145; B41J 2202/20; B41J 2202/19
See application file for complete search history.

(56) References Cited

U.S. PATENT DOCUMENTS

| | | | |
|---|---|---|---|
| 3,596,275 | A | 7/1971 | Sweet |
| 6,247,781 | B1 | 6/2001 | Blum |
| 6,457,807 | B1 | 10/2002 | Hawkins et al. |
| 6,491,362 | B1 | 12/2002 | Jeanmaire |
| 6,505,921 | B2 | 1/2003 | Chwalek et al. |
| 6,554,410 | B2 | 4/2003 | Jeanmaire et al. |
| 6,575,566 | B1 | 6/2003 | Jeanmaire et al. |
| 6,588,888 | B2 | 7/2003 | Jeanmaire et al. |
| 6,793,328 | B2 | 9/2004 | Jeanmaire |
| 6,824,243 | B2 | 11/2004 | Yamaguchi et al. |
| 6,827,429 | B2 | 12/2004 | Jeanmaire et al. |
| 6,851,796 | B2 | 2/2005 | Jeanmaire et al. |
| 6,910,756 | B2 | 6/2005 | Blum et al. |
| 7,456,033 | B2 | 11/2008 | Kishiro |

(Continued)

FOREIGN PATENT DOCUMENTS

| | | |
|---|---|---|
| EP | 805 031 | 1/2000 |

*Primary Examiner* — John P Zimmermann
(74) *Attorney, Agent, or Firm* — Kevin E. Spaulding

(57) ABSTRACT

A modular inkjet printhead assembly including a plurality of printhead modules mounted on both sides of a central rail assembly. The rail assembly includes a beam and two parallel sets of rod segments attached to upstream and downstream edges of the beam. The printhead modules include a jetting module having an array of nozzles, a first alignment tab having a first alignment datum and a second alignment datum, a second alignment tab having a third alignment datum and a fourth alignment datum, a rotational alignment feature including a fifth alignment datum, and a cross-track alignment feature including a sixth alignment datum. Portions of the alignment tabs of the jetting module are adapted to fit within corresponding notches in the beam. A clamping mechanism and a cross-track force mechanism apply forces to the jetting module that causes each alignment datum to engage with corresponding alignment features on the rail assembly.

25 Claims, 28 Drawing Sheets

(56) References Cited

U.S. PATENT DOCUMENTS

| | | | | |
|---|---|---|---|---|
| 7,470,002 | B2 | 12/2008 | Hibbard et al. | |
| 7,722,161 | B2 | 5/2010 | Hibbard et al. | |
| 7,819,501 | B2 | 10/2010 | Hanchak et al. | |
| 7,871,145 | B1 | 1/2011 | Enge | |
| 8,091,992 | B2 | 1/2012 | Hanchak | |
| 8,226,215 | B2 | 7/2012 | Bechler et al. | |
| 8,454,128 | B2 | 6/2013 | Fishkin et al. | |
| 8,469,496 | B2 | 6/2013 | Panchawagh et al. | |
| 8,585,189 | B1 | 11/2013 | Marcus et al. | |
| 8,641,175 | B2 | 2/2014 | Panchawagh et al. | |
| 8,651,632 | B2 | 2/2014 | Marcus et al. | |
| 8,651,633 | B2 | 2/2014 | Marcus et al. | |
| 8,657,419 | B2 | 2/2014 | Panchawagh et al. | |
| 8,696,094 | B2 | 4/2014 | Marcus et al. | |
| 8,840,207 | B2 * | 9/2014 | Wanibe | B41J 25/308 347/20 |
| 8,888,256 | B2 | 11/2014 | Marcus et al. | |
| 9,126,445 | B1 * | 9/2015 | Spence | B41J 25/34 |
| 9,259,916 | B1 | 2/2016 | Piatt et al. | |
| 9,527,319 | B1 | 12/2016 | Brazas, Jr. et al. | |
| 9,566,798 | B1 | 2/2017 | Tunmore et al. | |
| 9,623,689 | B1 | 4/2017 | Piatt et al. | |
| 2005/0156963 | A1 * | 7/2005 | Song | B41J 2/04505 347/9 |
| 2005/0206678 | A1 * | 9/2005 | Nishino | B41J 2/21 347/43 |
| 2011/0128323 | A1 * | 6/2011 | Saito | B41J 2/155 347/40 |

* cited by examiner

MODULAR PRINTHEAD ASSEMBLY WITH RAIL ASSEMBLY HAVING UPSTREAM AND DOWNSTREAM ROD SEGMENTS

FIELD OF THE INVENTION

This invention pertains to the field of inkjet printing and more particularly to a modular printhead assembly including a plurality of removable jetting modules.

BACKGROUND OF THE INVENTION

In the field of high speed inkjet printing it is desirable to be able to print across the width of the print media in a single pass of the print media past a print station. However, for many applications the desired print width exceeds the width of the available printheads. It is therefore necessary to arrange an array of printheads such that each printhead in the array prints a print swath, and the set of print swaths cover the entire print width. Whenever the printed image is made of a set of print swaths, it is necessary to align or stitch each pair of adjacent print swaths to each other such that the seam between adjacent print swaths is not visible.

For such printing applications, it is desirable to provide some means to accurately align the array of printheads relative to each other to provide consistency in the stitching of the print swaths. Even with improvements in the reliability of the printheads, it is desirable to provide means for removing and replacing individual printheads within the array of printheads. The structure for aligning the printheads into an array should therefore enable individual printheads to be removed from the array and replaced with another printhead with minimal change in the alignment of the printheads and their corresponding print swaths.

Commonly assigned U.S. Pat. No. 8,226,215 (Bechler et al.) provides a structure for aligning a plurality of printheads, with the printheads arranged in two staggered rows of printheads. It uses a printhead baseplate that includes sets of kinematic alignment features, one set for each printhead, to engage with alignment features on the printheads in order to provide repeatable alignment of the printheads.

Even with a fixed alignment of the array of printheads there is some variation in the quality of the stitching. It has been determined that the amplitude of the stitching variation depends in part on the spacing between the nozzle arrays in the two rows of printheads, with a smaller spacing between the rows yielding less variation in the stitching. It has also been found that as the desired print width increases, the cost for manufacturing the alignment baseplate to accommodate the increased print width increases significantly. There remains a need to provide an improved alignment system that can more readily accommodate wider print widths and provide a reduced spacing between the nozzle arrays in the rows of printheads.

In the field of continuous inkjet printing, each printhead includes a drop generator, which includes an array of nozzles, and drop selection hardware, which includes a mechanism to cause, for each of the nozzles in the array, the trajectories of printing drops to diverge from the trajectories of non-printing drops. An ink catcher is used to intercept the trajectory of the non-printing drops from each nozzle. It has been found that a skew of the drop selection hardware relative to the nozzle array can contribute to a skew of the images printed by the printhead relative to the print swaths of other printheads in an array of printheads. There remains a need for an improved system for aligning the drop selection hardware of a printhead relative to the nozzle array of a printhead.

As was pointed out in U.S. Pat. No. 3,596,275 (Sweet), it is desirable to provide a flow of air roughly parallel to the drop trajectory to reduce air drag artifact in the printed image. This air flow is commonly referred to as a collinear airflow, as the air flow being collinear or parallel to the drop trajectories as the air leaves the printhead through the gap between the catcher and the eyelid. Ideally the collinear airflow has a velocity approximately equal to the drop velocity so that the air drag on the print drops is reduced to near zero. The air flow in the region around the drop trajectories should be free from turbulence and should be uniform across the width of the jet array. There remains a need for improved systems for providing collinear airflow that is free from turbulence and that is uniform across the width of the jet array.

SUMMARY OF THE INVENTION

The present invention represents a modular inkjet printhead assembly including a plurality of jetting modules for printing on a print medium traveling along a media path from upstream to downstream, including:

a rail assembly spanning a print zone on the print medium in the cross-track direction, the rail assembly including:

- a beam having an upstream side, a downstream side and a print-medium-facing side that faces the print medium, wherein the upstream side and the print-medium-facing side intersect along an upstream edge and the downstream side and the print-medium-facing side intersect along a downstream edge;
- an upstream set of rod segments having collinear axes attached to the beam in proximity to the upstream edge; and
- a downstream set of rod segments having collinear axes attached to the beam in proximity to the downstream edge, wherein the axes of the upstream set of rod segments are parallel to the axes of the downstream set of rod segments;

a plurality of printhead modules, each printhead module including a corresponding jetting module, wherein each jetting module includes:

- an array of nozzles extending in a cross-track direction;
- a first alignment tab having a first alignment datum and a second alignment datum;
- a second alignment tab having a third alignment datum and a fourth alignment datum, the second alignment tab being spaced apart from the first alignment tab in the cross-track direction;
- a rotational alignment feature including a fifth alignment datum; and
- a cross-track alignment feature including a sixth alignment datum;

a jetting module clamping mechanism for each jetting module for applying a force to the associated jetting module that causes the first alignment datum, the second alignment datum, the third alignment datum and the fourth alignment datum of the associated jetting module to engage with a corresponding rod segment and causes the fifth alignment datum of the associated jetting module to engage with a corresponding rotational alignment feature associated with the beam; and a jetting module cross-track force mechanism for each jetting module for applying a cross-track force to the associated jetting module that causes the sixth alignment datum of the associated jetting module to engage with a corresponding cross-track alignment feature associated with the beam;

wherein each jetting module is adapted to engage with the rail assembly, wherein at least one of the jetting modules engages with the rail assembly on the upstream side of the beam such that the associated first alignment datum, second alignment datum, third alignment datum and fourth alignment datum engage with the upstream set of rod segments, and wherein at least one of the jetting modules engages with the rail assembly on the downstream side of the beam such that the associated first alignment datum, second alignment datum, third alignment datum and fourth alignment datum engage with the downstream set of rod segments.

This invention has the advantage that the jetting modules can be easily removed and replaced.

It has the additional advantage that a sufficient space is provided for an air flow duct that can provide uniform laminar air flow across the width of the jetting module.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use printheads to emit liquids (other than inks) that need to be finely metered and deposited with high spatial precision. As such, as described herein, the terms "liquid" and "ink" refer to any material that can be ejected by the printhead or printhead components described below.

Figure 1:
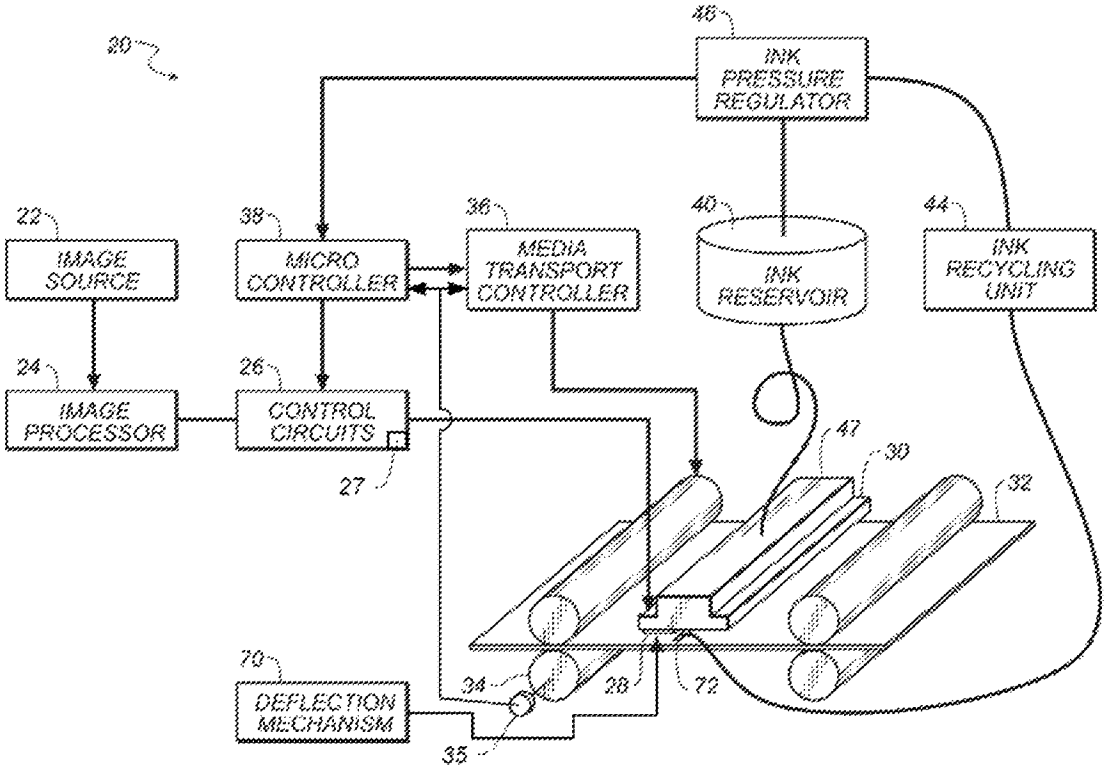
FIG. 1 (Prior Art)
FIG. 1 is a simplified block schematic diagram of an exemplary continuous inkjet system in accordance with the present invention.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit (image processor) 24 which also stores the image data in memory. A plurality of drop forming transducer control circuits 26 reads data from the image memory and apply time-varying electrical pulses to a drop forming transducers 28 that are associated with one or more nozzles of a printhead 30. These pulses are applied at an appropriate time, and to the appropriate nozzles, so that drops formed from a continuous ink jet stream will form spots on a print medium 32 in the appropriate position designated by the data in the image memory.

Print medium 32 is moved relative to the printhead 30 by a print medium transport system 34, which is electronically controlled by a media transport controller 36 in response to signals from a speed measurement device 35. The media transport controller 36 is in turn is controlled by a microcontroller 38. The print medium transport system shown in FIG. 1 is a schematic only, and many different mechanical configurations are possible. For example, a transfer roller could be used in the print medium transport system 34 to facilitate transfer of the ink drops to the print medium 32. Such transfer roller technology is well known in the art. In the case of page width printheads, it is most convenient to move the print medium 32 along a media path past a stationary printhead. However, in the case of scanning print systems, it is often most convenient to move the printhead along one axis (the sub-scanning direction) and the print medium 32 along an orthogonal axis (the main scanning direction) in a relative raster motion.

Ink is contained in an ink reservoir 40 under pressure. In the non-printing state, continuous ink jet drop streams are unable to reach print medium 32 due to an ink catcher 72 that blocks the stream of drops, and which may allow a portion of the ink to be recycled by an ink recycling unit 44. The ink recycling unit 44 reconditions the ink and feeds it back to the ink reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to the ink reservoir 40 under the control of an ink pressure regulator 46. Alternatively, the ink reservoir can be left unpressurized, or even under a reduced pressure (vacuum), and a pump can be employed to deliver ink from the ink reservoir under pressure to the printhead 30. In such an embodiment, the ink pressure regulator 46 can include an ink pump control system. The ink is distributed to the printhead 30 through an ink channel 47. The ink preferably flows through slots or holes etched through a silicon substrate of printhead 30 to its front surface, where a plurality of nozzles and drop forming transducers, for example, heaters, are situated. When printhead 30 is fabricated from silicon, the drop forming transducer control circuits 26 can be integrated with the printhead 30. The printhead 30 also includes a deflection mechanism 70 which is described in more detail below with reference to FIGS. 2 and 3.

Figure 2:
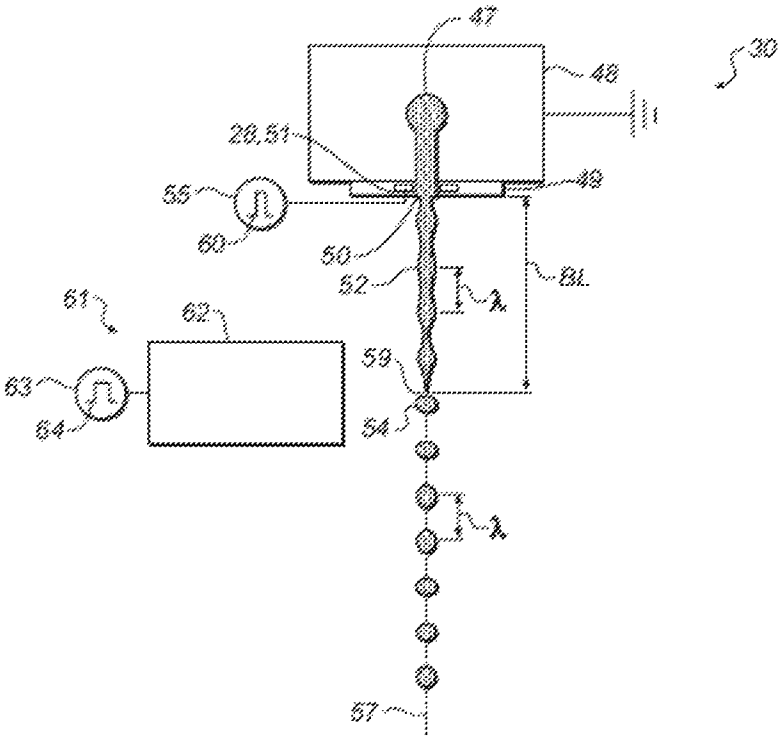
FIG. 2 (Prior Art)
FIG. 2 shows an image of a liquid jet being ejected from a drop generator and its subsequent break off into drops with a regular period.

Referring to FIG. 2, a schematic view of continuous liquid printhead 30 is shown. A jetting module 48 of printhead 30 includes an array of nozzles 50 formed in a nozzle plate 49. In FIG. 2, nozzle plate 49 is affixed to the jetting module 48. Alternatively, the nozzle plate 49 can be integrally formed with the jetting module 48. Liquid, for example, ink, is supplied to the nozzles 50 via ink channel 47 at a pressure sufficient to form continuous liquid streams 52 (sometimes referred to as filaments) from each nozzle 50. In FIG. 2, the array of nozzles 50 extends into and out of the figure.

Jetting module 48 is operable to cause liquid drops 54 to break off from the liquid stream 52 in response to image data. To accomplish this, jetting module 48 includes a drop stimulation or drop forming transducer 28 (e.g., a heater, a piezoelectric actuator, or an electrohydrodynamic stimulation electrode), that, when selectively activated, perturbs the liquid stream 52, to induce portions of each filament to break off and coalesce to form the drops 54. Depending on the type of transducer used, the transducer can be located in or adjacent to the liquid chamber that supplies the liquid to the nozzles 50 to act on the liquid in the liquid chamber, can be located in or immediately around the nozzles 50 to act on the liquid as it passes through the nozzle, or can be located adjacent to the liquid stream 52 to act on the liquid stream 50 after it has passed through the nozzle 50.

In FIG. 2, drop forming transducer 28 is a heater 51, for example, an asymmetric heater or a ring heater (either segmented or not segmented), located in the nozzle plate 49 on one or both sides of the nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat. No. 6,827,429 (Jeanmaire et al.); and U.S. Pat. No. 6,851,796 (Jeanmaire et al.), each of which is incorporated herein by reference.

Typically, one drop forming transducer 28 is associated with each nozzle 50 of the nozzle array. However, in some configurations, a drop forming transducer 28 can be associated with groups of nozzles 50 or all of the nozzles 50 in the nozzle array.

Referring to FIG. 2 the printing system has associated with it, a printhead 30 that is operable to produce, from an array of nozzles 50, an array of liquid streams 52. A drop forming device is associated with each liquid stream 52. The drop formation device includes a drop forming transducer 28 and a drop formation waveform source 55 that supplies a drop formation waveform 60 to the drop forming transducer 28. The drop formation waveform source 55 is a portion of the mechanism control circuits 26. In some embodiments in which the nozzle plate is fabricated of silicon, the drop formation waveform source 55 is formed at least partially on the nozzle plate 49. The drop formation waveform source 55 supplies a drop formation waveform 60, which typically includes a sequence of pulses having a fundamental frequency $f_o$ and a fundamental period of $T_o=1/f_o$, to the drop formation transducer 28, which produces a modulation in the liquid jet with a wavelength $\lambda$. The modulation grows in amplitude to cause portions of the liquid stream 52 to break off into drops 54. Through the action of the drop formation device, a sequence of drops 54 is produced. In accordance with the drop formation waveform 60, the drops 54 are formed at the fundamental frequency $f_o$ with a fundamental period of $T_o=1/f_o$. In FIG. 2, liquid stream 52 breaks off into drops with a regular period at breakoff location 59, which is a distance, called the break off length, BL from the nozzle 50. The distance between a pair of successive drops 54 is essentially equal to the wavelength $\lambda$ of the perturbation on the liquid stream 52. The stream of drops 54 formed from the liquid stream 52 follow an initial trajectory 57.

The break off time of the droplet for a particular printhead can be altered by changing at least one of the amplitude, duty cycle, or number of the stimulation pulses to the respective resistive elements surrounding a respective resistive nozzle orifice. In this way, small variations of either pulse duty cycle or amplitude allow the droplet break off times to be modulated in a predictable fashion within ±one-tenth the droplet generation period.

Also shown in FIG. 2 is a charging device 61 comprising charging electrode 62 and charging electrode waveform source 63. The charging electrode 62 associated with the liquid jet is positioned adjacent to the break off point 59 of the liquid stream 52. If a voltage is applied to the charging electrode 62, electric fields are produced between the charging electrode and the electrically grounded liquid jet, and the capacitive coupling between the two produces a net charge on the end of the electrically conductive liquid stream 52. (The liquid stream 52 is grounded by means of contact with the liquid chamber of the grounded drop generator.) If the end portion of the liquid jet breaks off to form a drop while there is a net charge on the end of the liquid stream 52, the charge of that end portion of the liquid stream 52 is trapped on the newly formed drop 54.

Figure 4:
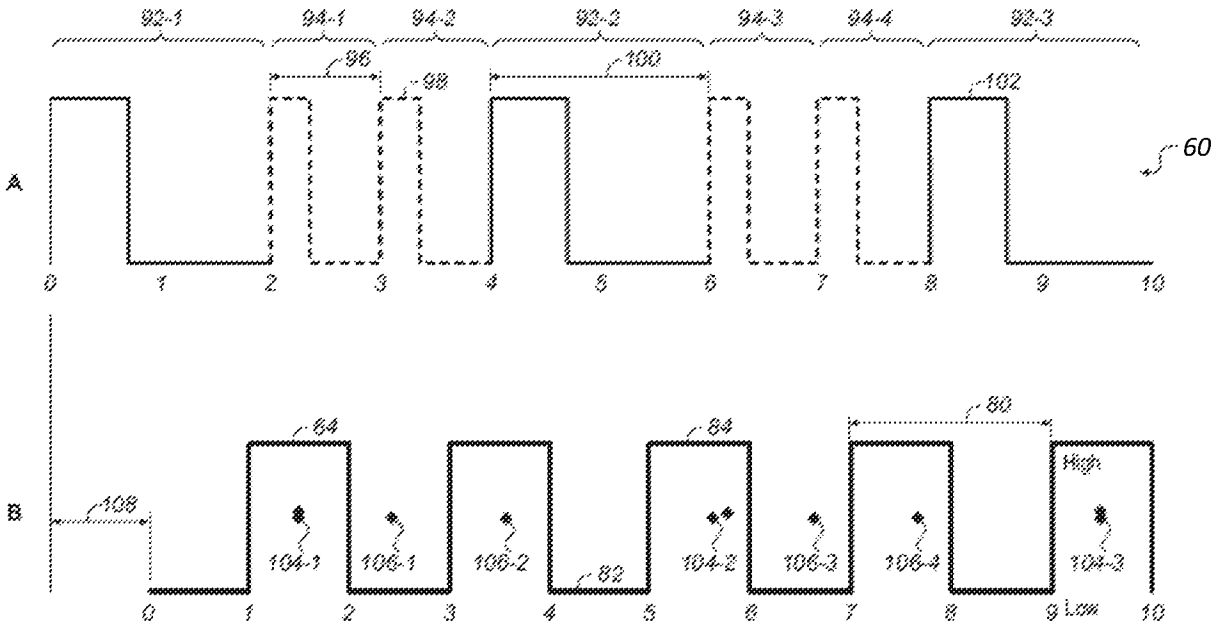
FIG. 4 (Prior Art)
FIG. 4 shows a first example embodiment of a timing diagram illustrating drop formation pulses, the charging electrode waveform, and the break-off of drops.

The voltage on the charging electrode 62 is controlled by the charging electrode waveform source 63, which provides a charging electrode waveform 64 operating at a charging electrode waveform 64 period 80 (shown in FIG. 4). The charging electrode waveform source 63 provides a varying electrical potential between the charging electrode 62 and the liquid stream 52. The charging electrode waveform source 63 generates a charging electrode waveform 64, which includes a first voltage state and a second voltage state; the first voltage state being distinct from the second voltage state. An example of a charging electrode waveform is shown in part B of FIG. 4. The two voltages are selected such that the drops 54 breaking off during the first voltage state acquire a first charge state and the drops 54 breaking off during the second voltage state acquire a second charge state. The charging electrode waveform 64 supplied to the charging electrode 62 is independent of, or not responsive to, the image data to be printed. The charging device 61 is synchronized with the drop formation device using a conventional synchronization device 27, which is a portion of the control circuits 26, (see FIG. 1) so that a fixed phase relationship is maintained between the charging electrode waveform 64 produced by the charging electrode waveform source 63 and the clock of the drop formation waveform source 55. As a result, the phase of the break off of drops 54 from the liquid stream 52, produced by the drop formation waveforms 92-1, 92-2, 92-3, 94-1, 94-2, 94-3, 94-4 (see FIG. 4), is phase locked to the charging electrode waveform 64. As indicated in FIG. 4, there can be a phase shift 108, between the charging electrode waveform 64 and the drop formation waveforms 92-1, 92-2, 92-3, 94-1, 94-2, 94-3, 94-4.

Figure 3:
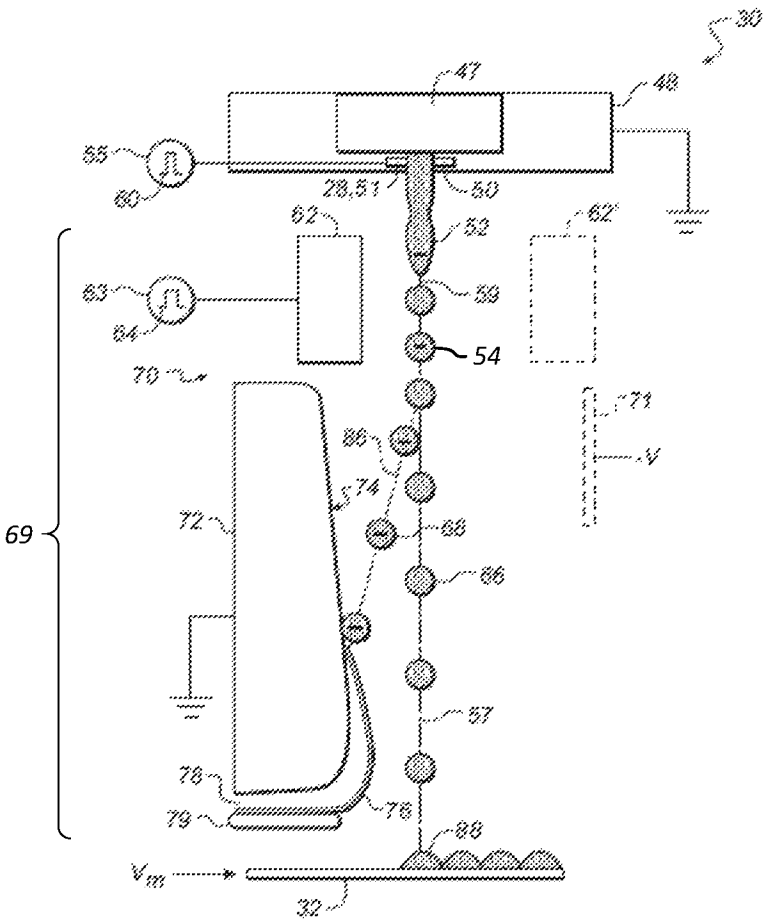
FIG. 3 (Prior Art)
FIG. 3 shows a cross sectional of an inkjet printhead of the continuous liquid ejection system in accordance with the present invention.

With reference now to FIG. 3, printhead 30 includes a drop forming transducer 28 which creates a liquid stream 52 that breaks up into ink drops 54. Selection of drops 54 as printing drops 66 or non-printing drops 68 will depend upon the phase of the droplet break off relative to the charging electrode voltage pulses that are applied to the to the charging electrode 62 that is part of the deflection mechanism 70, as will be described below. The charging electrode 62 is variably biased by a charging electrode waveform source 63. The charging electrode waveform source 63 provides a charging electrode waveform 64, in the form of a sequence of charging pulses. The charging electrode waveform 64 is periodic, having a charging electrode waveform 64 period 80 (FIG. 4).

An embodiment of a charging electrode waveform 64 is shown in part B of FIG. 4. The charging electrode waveform 64 comprises a first voltage state 82 and a second voltage state 84. Drops breaking off during the first voltage state 82 are charged to a first charge state and drops breaking off during the second voltage state 84 are charged to a second charge state. The second voltage state 84 is typically at a high level, biased sufficiently to charge the drops 54 as they break off. The first voltage state 82 is typically at a low level relative to the printhead 30 such that the first charge state is relatively uncharged when compared to the second charge state. An exemplary range of values of the electrical potential difference between the first voltage state 82 and a second voltage state 84 is 50 to 300 volts and more preferably 90 to 150 volts.

Returning to a discussion of FIG. 3, when a relatively high level voltage or electrical potential is applied to the charging electrode 62 and a drop 54 breaks off from the liquid stream 52 in front of the charging electrode 62, the drop 54 acquires a charge and is deflected by deflection mechanism 70 towards the ink catcher 72 as non-printing drop 68. The non-printing drops 68 that strike the catcher face 74 form an ink film 76 on the face of the ink catcher 72. The ink film 76 flows down the catcher face 74 and enters liquid channel 78 (also called an ink channel), through which it flows to the ink recycling unit 44. The liquid channel 78 is typically formed between the body of the ink catcher 72 and a lower plate 79.

Deflection occurs when drops 54 break off from the liquid stream 52 while the potential of the charging electrode 62 is provided with an appropriate voltage. The drops 54 will then acquire an induced electrical charge that remains upon the droplet surface. The charge on an individual drop 54 has a polarity opposite that of the charging electrode 62 and a magnitude that is dependent upon the magnitude of the voltage and the coupling capacitance between the charging electrode 62 and the drop 54 at the instant the drop 54 separates from the liquid jet. This coupling capacitance is dependent in part on the spacing between the charging electrode 62 and the drop 54 as it is breaking off. It can also be dependent on the vertical position of the breakoff point 59 relative to the center of the charge electrode 62. After the charged drops 54 have broken away from the liquid stream 52, they continue to pass through the electric fields produced by the charge plate. These electric fields provide a force on the charged drops deflecting them toward the charging electrode 62. The charging electrode 62, even though it cycled between the first and the second voltage states, thus acts as a deflection electrode to help deflect charged drops away from the initial trajectory 57 and toward the ink catcher 72. After passing the charging electrode 62, the drops 54 will travel in close proximity to the catcher face 74 which is typically constructed of a conductor or dielectric. The charges on the surface of the non-printing drops 68 will induce either a surface charge density charge (for a catcher face 74 constructed of a conductor) or a polarization density charge (for a catcher face 74 constructed of a dielectric). The induced charges on the catcher face 74 produce an attractive force on the charged non-printing drops 68. The attractive force on the non-printing drops 68 is identical to that which would be produced by a fictitious charge (opposite in polarity and equal in magnitude) located inside the ink catcher 72 at a distance from the surface equal to the distance between the ink catcher 72 and the non-printing drops 68. The fictitious charge is called an image charge. The attractive force exerted on the charged non-printing drops 68 by the catcher face 74 causes the charged non-printing drops 68 to deflect away from their initial trajectory 57 and accelerate along a non-print trajectory 86 toward the catcher face 74 at a rate proportional to the square of the droplet charge and inversely proportional to the droplet mass. In this embodiment, the ink catcher 72, due to the induced charge distribution, comprises a portion of the deflection mechanism 70. In other embodiments, the deflection mechanism 70 can include one or more additional electrodes to generate an electric field through which the charged droplets pass so as to deflect the charged droplets. For example, an optional single biased deflection electrode 71 in front of the upper grounded portion of the catcher can be used. In some embodiments, the charging electrode 62 can include a second portion on the second side of the jet array, denoted by the dashed line charging electrode 62', which supplied with the same charging electrode waveform 64 as the first portion of the charging electrode 62.

In the alternative, when the drop formation waveform 60 applied to the drop forming transducer 28 causes a drop 54 to break off from the liquid stream 52 when the electrical potential of the charging electrode 62 is at the first voltage state 82 (FIG. 4) (i.e., at a relatively low potential or at a zero potential), the drop 54 does not acquire a charge. Such uncharged drops are unaffected during their flight by electric fields that deflect the charged drops. The uncharged drops therefore becomes printing drops 66, which travel in a generally undeflected path along the trajectory 57 and impact the print medium 32 to form a print dots 88 on the print medium 32, as the recoding medium is moved past the printhead 30 at a speed $V_m$. The charging electrode 62, deflection electrode 71 and ink catcher 72 serve as a drop selection system 69 for the printhead 30.

FIG. 4 illustrates how selected drops can be printed by the control of the drop formation waveforms supplied to the drop forming transducer 28. Section A of FIG. 4 shows a drop formation waveform 60 formed as a sequence that includes three drop formation waveform 92-1, 92-2, 92-3, and four drop formation waveforms 94-1, 94-2, 94-3, 94-4. The drop formation waveforms 94-1, 94-2, 94-3, 94-4 each have a period 96 and include a pulse 98, and each of the drop formation waveforms 92-1, 92-2, 92-3 have a longer period 100 and include a longer pulse 102. In this example, the period 96 of the drop formation waveforms 94-1, 94-2, 94-3, 94-4 is the fundamental period $T_o$, and the period 100 of the drop formation waveforms 92-1, 92-2, 92-3 is twice the fundamental period, $2T_o$. The drop formation waveforms 94-1, 94-2, 94-3, 94-4 each cause individual drops to break off from the liquid stream. The drop formation waveforms 92-1, 92-2, 92-3, due to their longer period, each cause a larger drop to be formed from the liquid stream. The larger drops 54 formed by the drop formation waveforms 92-1, 92-2, 92-3 each have a volume that is approximately equal to twice the volume of the drops 54 formed by the drop formation waveforms 94-1, 94-2, 94-3, 94-4.

As previously mentioned, the charge induced on a drop 54 depends on the voltage state of the charging electrode at the instant of drop breakoff. The B section of FIG. 4 shows the charging electrode waveform 64 and the times, denoted by the diamonds, at which the drops 54 break off from the liquid stream 52. The waveforms 92-1, 92-2, 92-3 cause large drops 104-1, 104-2, 104-3 to break off from the liquid stream 52 while the charging electrode waveform 64 is in the second voltage state 84. Due to the high voltage applied to the charging electrode 62 in the second voltage state 84, the large drops 104-1, 104-2, 104-3 are charged to a level that causes them to be deflected as non-printing drops 68 such that they strike the catcher face 74 of the ink catcher 72 in FIG. 3. These large drops may be formed as a single drop (denoted by the double diamond for 104-1), as two drops that break off from the liquid stream 52 at almost the same time that subsequently merge to form a large drop (denoted by two closely spaced diamonds for 104-2), or as a large drop that breaks off from the liquid stream that breaks apart and then merges back to a large drop (denoted by the double diamond for 104-3). The waveforms 94-1, 94-2, 94-3, 94-4 cause small drops 106-1, 106-2, 106-2, 106-3, 106-4 to form. Small drops 106-1 and 106-3 break off during the first voltage state 82, and therefore will be relatively uncharged; they are not deflected into the ink catcher 72, but rather pass by the ink catcher 72 as printing drops 66 and strike the print media 32 (see FIG. 3). Small drops 106-2 and 106-4 break off during the second voltage state 84 and are deflected to strike the ink catcher 74 as non-printing drops 68. The charging electrode waveform 64 is not controlled by the pixel data to be printed, while the drop formation waveform 60 is determined by the print data. This type of drop deflection is known and has been described in, for example, U.S. Pat. No. 8,585,189 (Marcus et al.); U.S. Pat. No. 8,651,632 (Marcus); U.S. Pat. No. 8,651,633 (Marcus et al.); U.S. Pat. No. 8,696,094 (Marcus et al.); and U.S. Pat. No. 8,888,256 (Marcus et al.), each of which is incorporated herein by reference.

Figure 5:
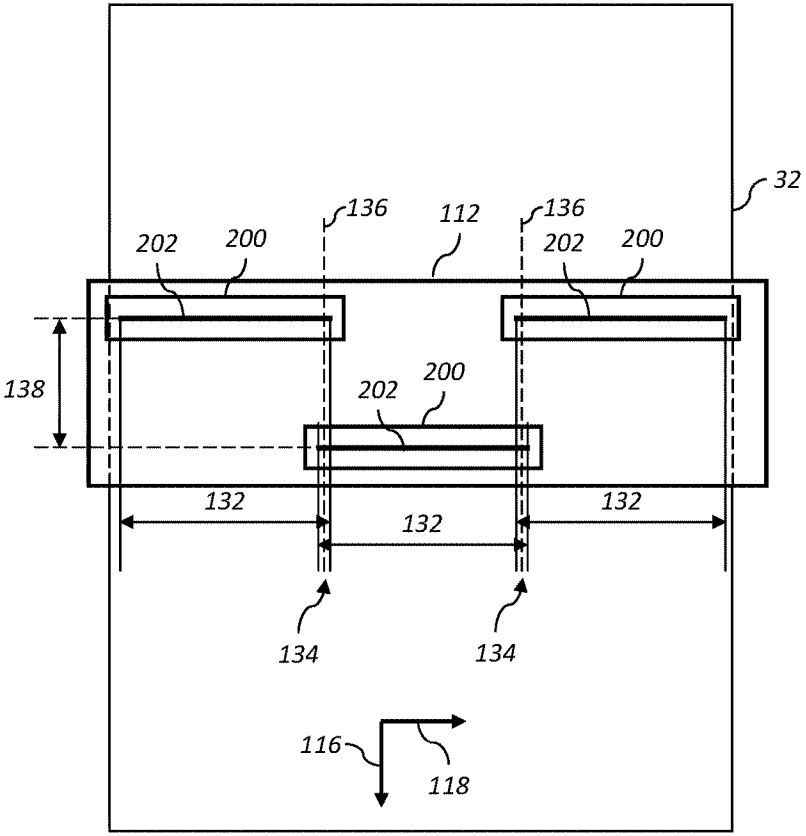
FIG. 5 (Prior Art)
FIG. 5 shows a top view of an exemplary printhead assembly including a staggered array of jetting modules.

FIG. 5 is a diagram of an exemplary inkjet printhead assembly 112. The printhead assembly 112 includes a plurality of jetting modules 200 arranged across a width dimension of the print medium 32 in a staggered array configuration. The width dimension of the print medium 32 is the dimension in cross-track direction 118, which is perpendicular to in-track direction 116 (i.e., the motion direction of the print medium 32). Such printhead assemblies 112 are sometimes referred to as "lineheads."

Each of the jetting modules 200 includes a plurality of inkjet nozzles arranged in nozzle array 202, and is adapted to print a swath of image data in a corresponding printing region 132. Commonly, the jetting modules 200 are arranged in a spatially-overlapping arrangement where the printing regions 132 overlap in overlap regions 134. Each of the overlap regions 134 has a corresponding centerline 136. In the overlap regions 134, nozzles from more than one nozzle array 202 can be used to print the image data.

Stitching is a process that refers to the alignment of the printed images produced from jetting modules 200 for the purpose of creating the appearance of a single page-width line head. In the exemplary arrangement shown in FIG. 2, three printheads 200 are stitched together at overlap regions 134 to form a page-width printhead assembly 112. The page-width image data is processed and segmented into separate portions that are sent to each jetting module 200 with appropriate time delays to account for the staggered positions of the jetting modules 200. The image data portions printed by each of the jetting modules 200 is sometimes referred to as "swaths." Stitching systems and algorithms are used to determine which nozzles of each nozzle array 202 should be used for printing in the overlap region 134. Preferably, the stitching algorithms create a boundary between the printing regions 132 that is not readily detected by eye. One such stitching algorithm is described in commonly-assigned U.S. Pat. No. 7,871,145 (Enge), which is incorporated herein by reference.

The two lines of nozzle arrays 202 in the staggered arrangement are separated by a nozzle array spacing 138. It has been found that larger nozzle array spacing 138 result in large amplitudes of the stitching variation, even after stitching correction algorithms are applied. Therefore, it is desirable to reduce the nozzle array spacing 138 as much as possible. With prior art arrangements for mounting the nozzle arrays 202, such as that described in the aforementioned, commonly-assigned U.S. Pat. No. 8,226,215 there is a limit to how small the nozzle array spacing 138. These methods also get expensive and cumbersome when it is necessary to use increasing numbers of jetting modules in the line head to accommodate larger and larger print widths. These limitations are addressed with the modular inkjet printhead assembly described herein.

Figure 6:
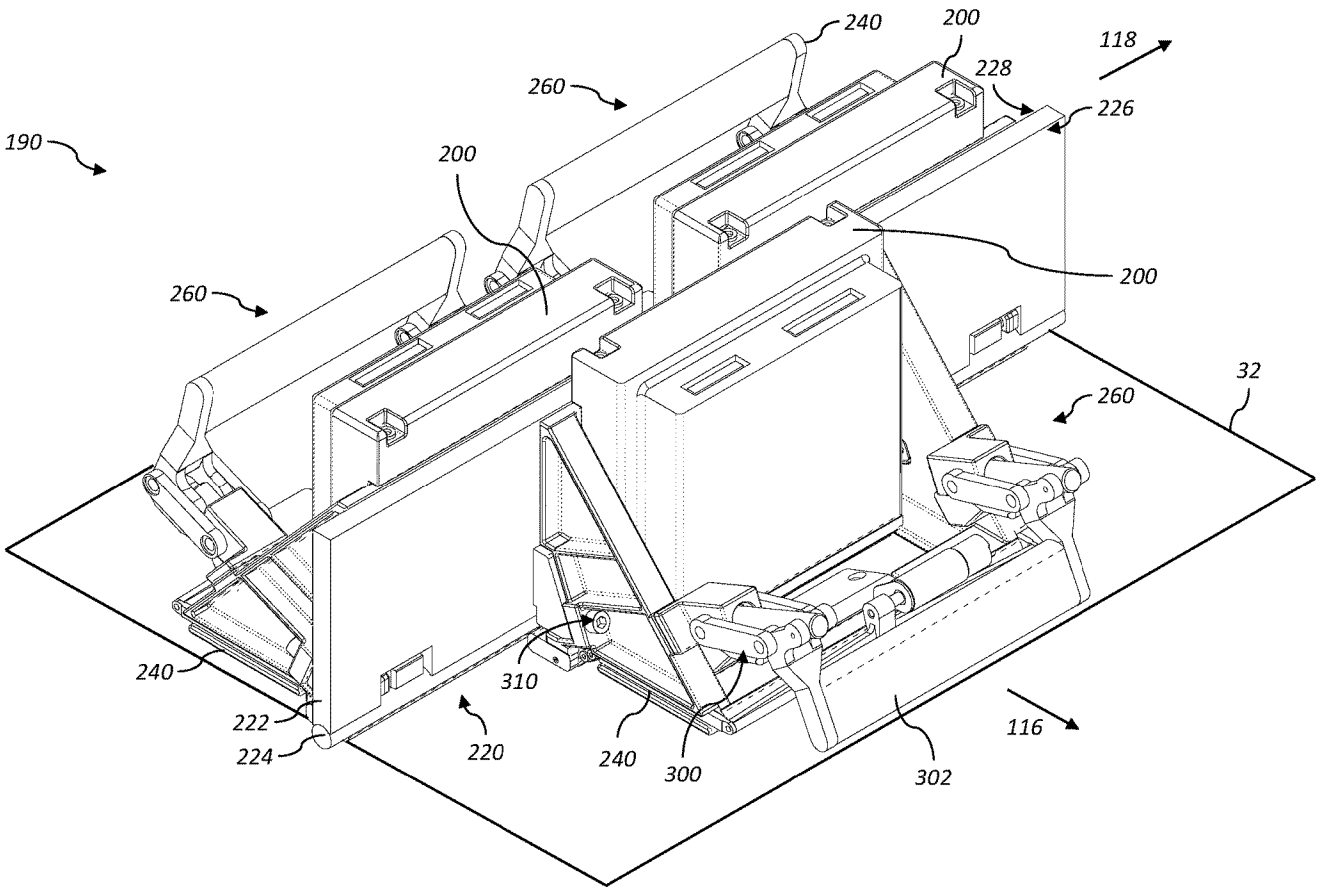
FIG. 6 shows an exemplary modular printhead assembly including a plurality of printhead modules mounted onto a central rail assembly in accordance with the present invention.

FIG. 6 shows an exemplary modular printhead assembly 190 including a plurality of printhead modules 260 in accordance with the present invention. Each printhead module 260 includes a jetting module 200 and a mounting assembly 240. The printhead modules 260 are mounted onto a central rail assembly 220, which includes a rod 224 attached onto the print-medium-facing side of a beam 222 that faces the print medium 32. The print medium 32 moves past the printhead assembly 190 in an in-track direction 116. The rail assembly 240 extends across the width of a print zone on the print medium 32 in a cross-track direction 118. The print zone corresponds to the portion of the print medium 32 onto which the printhead assembly 190 is adapted to print.

In the illustrated configuration, the printhead assembly 190 includes three printhead modules 260, with one being mounted on a downstream side 226 of the beam 222, and two being mounted on an upstream side 228 of the beam 222. An advantageous feature of this modular printhead assembly 190 design is that wider print media 32 can be supported by simply extending the length of the rail assembly 220 and adding additional printhead modules 260. By alternating the printhead modules 260 between the downstream side 226 and the upstream side 228 of the beam 222, the associated nozzle arrays 202 can be stitched together with appropriate overlap regions 134 (see FIG. 5).

Figure 7:
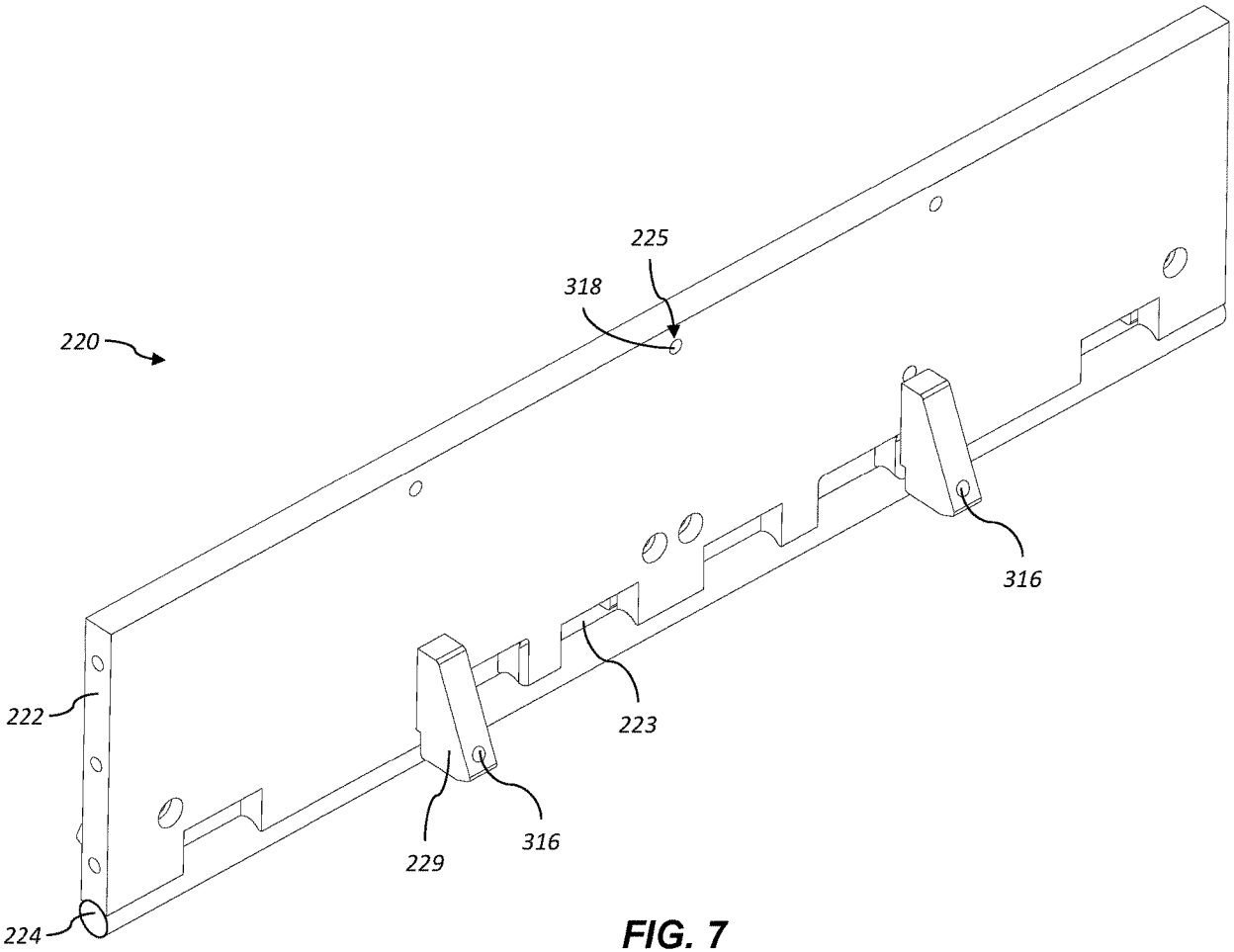
FIG. 7 illustrates additional details of the rail assembly in the modular printhead assembly of FIG. 6.

FIG. 7 shows additional details for an exemplary embodiment of the rail assembly 220 of FIG. 6. The rail assembly 220 includes rod 224, which is attached to the print-medium-facing side of beam 222 (i.e., the side that faces the print medium 32 (FIG. 6). Mounting brackets 229 are attached to the beam 222 for used for clamping the mounting assembly 240 to the rail assembly 220.

In the illustrated configuration, the rod 224 has a cylindrical shape, and the print-medium-facing side of the beam 222 has a concave profile that matches the shape of the outer surface of the rod 224. In other configurations, the beam and the rod 224 can have different shapes. For example, the print-medium-facing side of the beam 222 can have a v-shaped groove that sits on the outer surface of the rod 224. In another example, the rod 224 can have a cylindrical shape around a portion of the circumference, but can have a flat surface on one side to facilitate attaching the rod 224 to a beam 222 having a flat print-medium-facing side. The rod 224 can be attached to the beam 222 using any appropriate means. For example, bolts can be inserted through holes in the rod 224 into corresponding threaded holes in the print-medium-facing side of the beam 222.

The beam 222 includes a series of notches 223 that are adapted to receive tabs on the jetting modules 200 and the mounting assemblies 240 (FIG. 6) as will be discussed later. In an exemplary embodiment, two notches 223 are provided for each of the printhead modules 260 (FIG. 6) at locations corresponding to the positions of the tabs, which are preferably provided in proximity to first and second ends the jetting modules 200 and the mounting assemblies 240. (Within the context of the present disclosure, "in proximity" to an end means that the distance between the end and the notch is no more than 20% of the distance between the two ends.) In the illustrated configuration, the notches 223 extend all the way through the beam 222. In other configurations, the notches 223 may extend only part of the way through. As will be discussed later, the beam also includes rotational alignment features 225 that are adapted to engage with a corresponding datum on the mounting assemblies 240 or the jetting modules 200.

Figure 8:
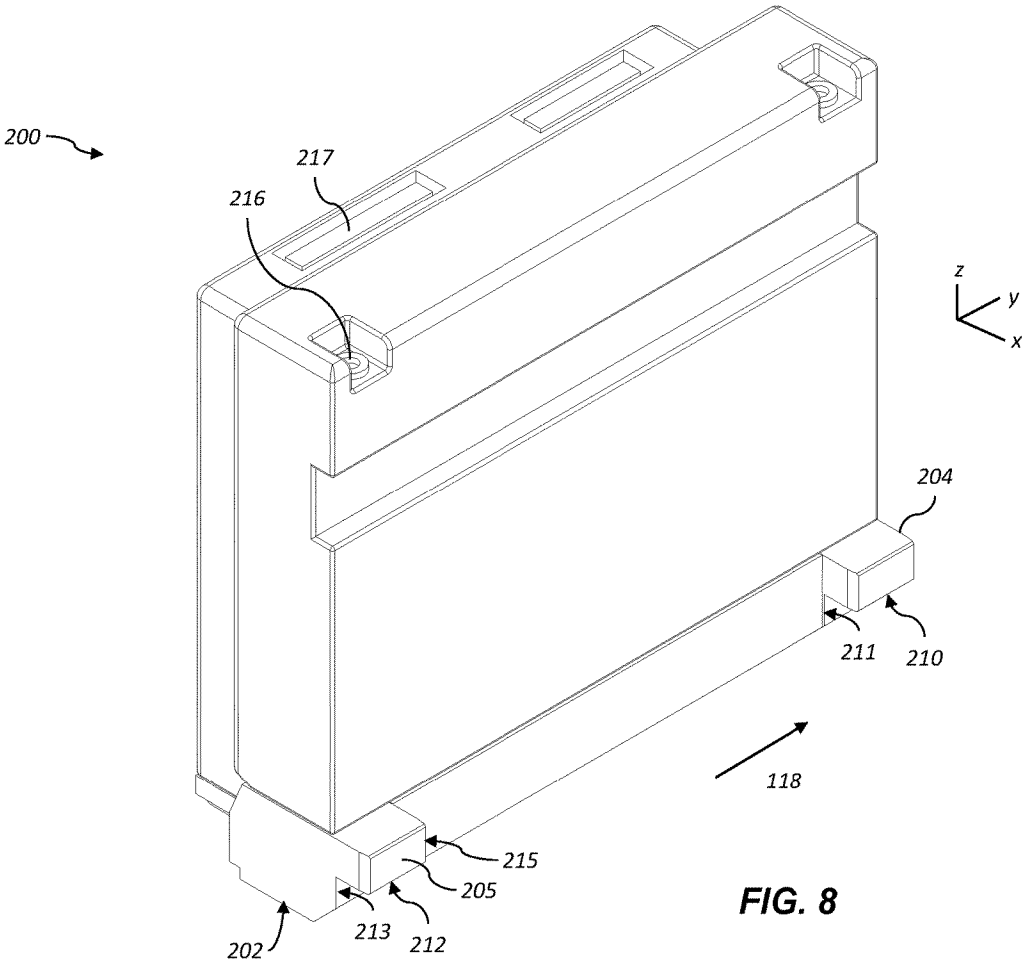
FIG. 8 illustrates additional details of the jetting modules in the modular printhead assembly of FIG. 6.

FIG. 8 shows additional details for an exemplary embodiment of the jetting module 200 of FIG. 6. A nozzle array 220 (not visible in FIG. 8) extends across the width of the jetting module 200 in the cross track direction 118. Fluid connections 216 and electrical connections 217 connect to other components of the printer system 20 (FIG. 1).

The jetting module 200 includes first and second alignment tabs 204, 205 spaced apart in the cross-track direction 118 that are configured to be inserted into the notches 223 in the beam 222 and to engage with the rod 224 of the rail assembly 220 (FIG. 7). In order to define the desired position of the jetting module 200 relative to the rail assembly 220 requires constraining six degrees of freedom using six alignment features. The first alignment tab 204 provides a first alignment datum 210 and a second alignment datum 211. The second alignment tab 205 provides a third alignment datum 212 and a fourth alignment datum 213. The engagement between the first and second alignment tabs 204, 205 with the rod 224 define four degrees of freedom (x, z, $\theta_x$, $\theta_z$).

The jetting module 200 also includes a rotational alignment feature providing a fifth alignment datum 214 (not visible in FIG. 8), which is adapted to engage with a corresponding rotational alignment feature associated with the beam 222 to define the fifth degree of freedom ($\theta_y$). The rotational alignment feature associated with the beam 222 may be on the beam 222 itself, or can be on the mounting assembly 240, which is in a predefined position relative to the beam 222. In the illustrated configuration, the fifth alignment datum 214 is on the bottom surface of the jetting module 200, and contacts a component of the mounting assembly 240 (see FIG. 12B).

The jetting module 200 also includes a cross-track alignment feature providing a sixth alignment datum 215, which is adapted to engage with a corresponding cross-track alignment feature on the rail assembly 220 to define the sixth degree of freedom (y). In the illustrated configuration, the sixth alignment datum 215 is provided on a side face of the second alignment tab 205, and the corresponding cross-track alignment feature on the rail assembly 220 is provided by a side face of the corresponding notch 223 in the beam 222. While the sixth alignment datum 215 is shown on the inside face of the second alignment tab 205, one skilled in the art will recognize that it could alternatively be on the outside face. In other configurations, the sixth alignment datum 215 can be a side face of the first alignment tab 204, or can be provided by some other feature on the jetting module 200.

The first and second alignment tabs 204, 205 of the jetting module 200 can take any appropriate form. FIGS. 9A-9E illustrate a number of exemplary configurations that can be used. Each configuration includes a "v-shaped" notch 206, which is formed into the alignment tab 204. The notch 206 has two faces 207, 208, each of which provides a corresponding alignment datum 210, 211 at the location where the alignment tab 204 contacts the rod 224. In the illustrated examples, the faces 207, 208 are oriented at 90° to each other, but this is not a requirement. Fixtures can be provided during the manufacturing process for the jetting module 200 to accurately machine the positions of the faces 207, 208 relative to the position of the nozzle array 202, so that the nozzle array 202 can be accurately aligned relative to the rail assembly 220.

Figure 9C:
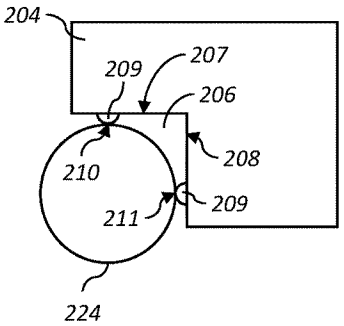
FIGS. 9A-9E illustrate exemplary alignment tab configurations.
Figure 9B:
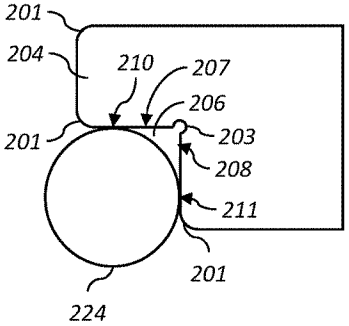
Figure 9A:
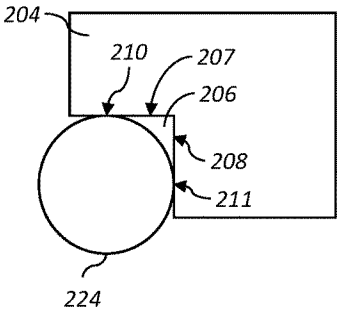
Figure 9E:
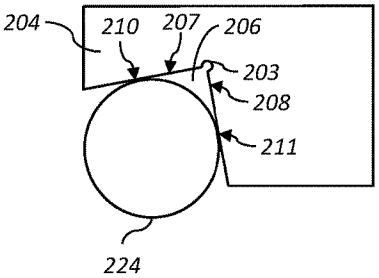
Figure 9D:
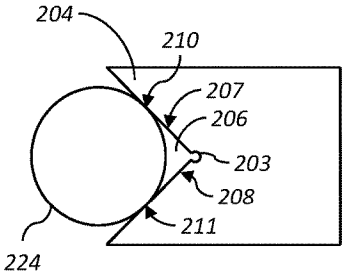

In FIG. 9A the notch 206 has sharp corners and includes a horizontal face 210 and a vertical face 211. The alignment tab 204 of FIG. 9B is similar except that the outer corners include fillets 201 and the inner corner includes an endmill 203. The alignment tab 204 of FIG. 9C includes protrusions 209 which provide the contact points (alignment datum 210 and alignment datum 211) with the rod 224. For example, the protrusions 209 can be ball bearings that provide a single point of contact. In FIGS. 9D and 9E the notches 206 are rotated so that the faces 207, 208 are diagonal. In FIG. 9D, the faces 207, 208 are oriented at +45° relative to the horizontal. In FIG. 9E, the face 207 tilts backward by a small angle (e.g., about 10°). This has the advantage that the downward weight of the jetting module 200 will have the effect of pulling the jetting module 200 toward the rail assembly 220.

Figure 10:
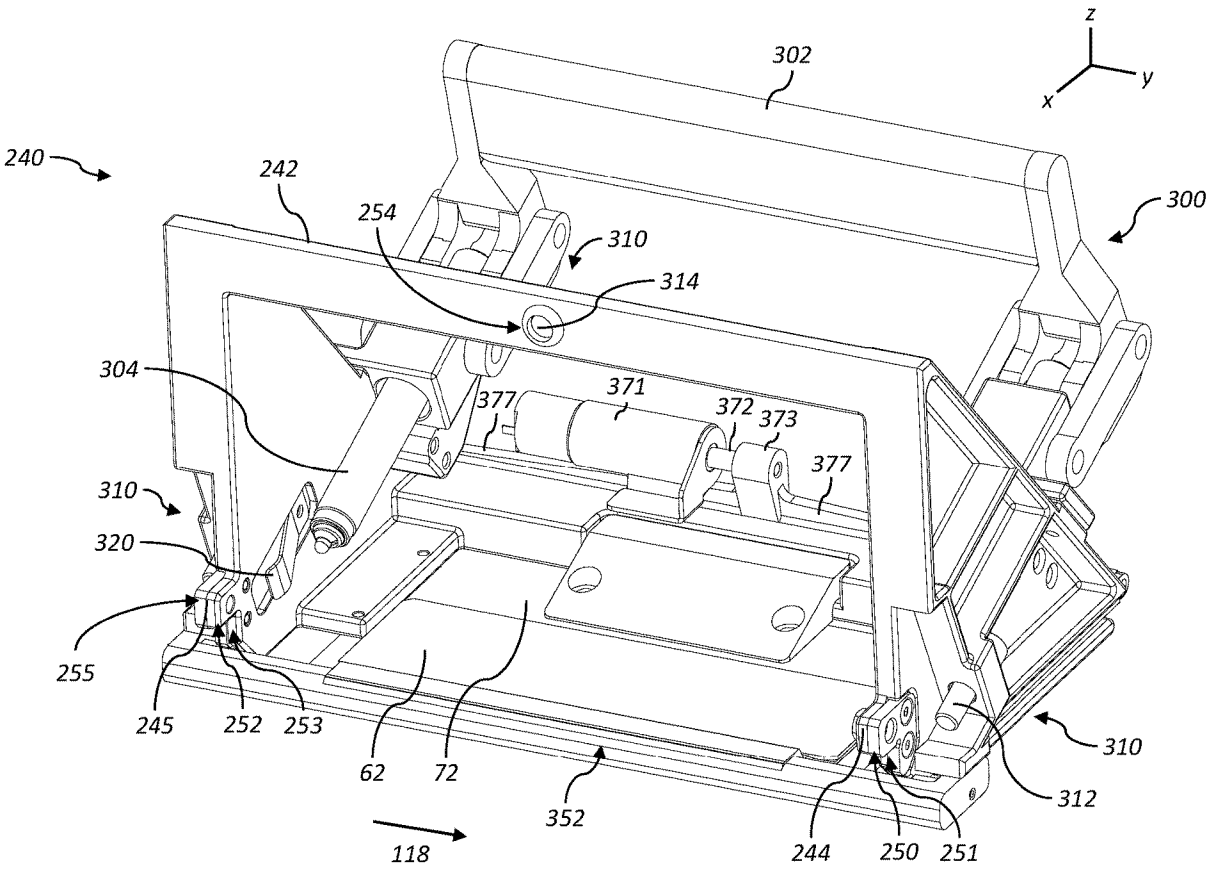
FIG. 10 illustrates additional details of the mounting assemblies in the modular printhead assembly of FIG. 6.

FIG. 10 shows additional details for an exemplary embodiment of the mounting assembly 240 of FIG. 6. The mounting assembly 240 includes third and fourth alignment tabs 244, 245 protruding from a frame 242. The alignment tabs 244, 245 are spaced apart in the cross-track direction 118 and are configured to be inserted into the notches 223 in the beam 222 and to engage with the rod 224 of the rail assembly 220 (FIG. 7). The alignment tabs 244, 245 of the mounting assembly 240 can take any appropriate form that provides two contact points with the rod 224, such as those shown in FIGS. 9A-9E.

In order to define the desired position of the mounting assembly 240 relative to the rail assembly 220 requires constraining six degrees of freedom using six alignment features. The third alignment tab 244 provides a seventh alignment datum 250 and an eighth alignment datum 251. The fourth alignment tab 245 provides a ninth alignment datum 252 and a tenth alignment datum 253. The engagement between the alignment tabs 244, 245 with the rod 224 therefore define four degrees of freedom (x, z, $\theta_x$, $\theta_z$).

The mounting assembly 240 also includes a rotational alignment feature providing an eleventh alignment datum 254, which is adapted to engage with a corresponding rotational alignment feature 225 (FIG. 7) on the beam 222 to define the fifth degree of freedom ($\theta_y$). In the illustrated configuration, the eleventh alignment datum 254 is a ring that protrudes slightly from the upper cross-piece of the frame 242.

The mounting assembly 240 also includes a cross-track alignment feature providing a twelfth alignment datum 255, which is adapted to engage with a corresponding cross-track alignment feature on the rail assembly 220 to define the sixth degree of freedom (y). In the illustrated configuration, the twelfth alignment datum 255 is provided on a side face of the fourth alignment tab 245, and the corresponding cross-track alignment feature on the rail assembly 220 is provided by a side face of the corresponding notch 223 in the beam 222. While the twelfth alignment datum 255 is shown on the outside face of the fourth alignment tab 205, one skilled in the art will recognize that it could alternatively be on the inside face. In other configurations, the twelfth alignment datum 255 can be a side face of the third alignment tab 245, or can be provided by some other feature on the mounting assembly 240.

Figure 16:
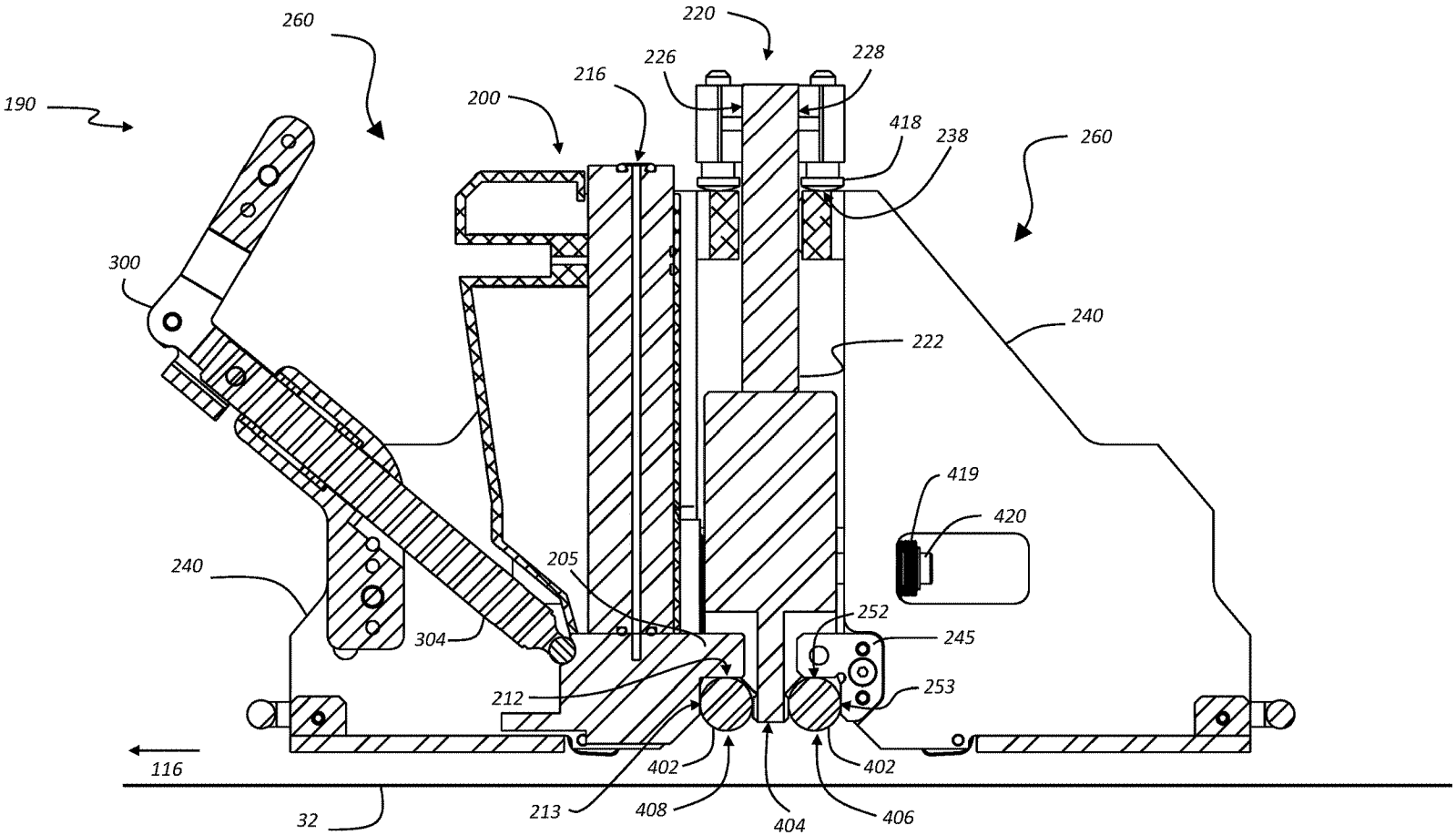
FIG. 16 show a cross-sectional view of an exemplary printhead assembly including the rail assembly of FIG. 14 and attached upstream and downstream printhead modules.

A mounting assembly clamping mechanism 310 is used to apply a clamping force to the mounting assembly 240 clamping it to the rail assembly 220. The clamping force causes the seventh alignment datum 250, the eighth alignment datum 251, the ninth alignment datum 252, and the tenth alignment datum 253 of the mounting assembly 240 to engage with the rod 224, and causes the eleventh alignment datum 254 of the mounting assembly 240 to engage with the corresponding alignment feature 225 (FIG. 7) on the beam 222. In the illustrated configuration, the mounting assembly clamping mechanism 310 is provided by three bolts 312. One of the bolts 312 is shown on one side of the mounting assembly 240 in proximity to the third alignment tab 244. This bolt 312 threads into a threaded hole 316 on the mounting bracket 229 (see FIG. 7), which is attached to the beam 222. Likewise another bolt 312 (not visible in FIG. 10) will be on the other side of the mounting assembly 240 in proximity to the fourth alignment tab 245. As the bolts 312 engage the bolt holes 314, the slope of the face of the mounting bracket 229 and of the bolt hole provide a downward force in addition to a lateral force on the mounting assembly 240 to help ensure that the alignment datum 250, 251, 252, and 253 each properly engage the rod 224. A third bolt 312 (not shown in FIG. 10) would be inserted through the bolt hole 314 shown in the top rail of the frame 242 and into a threaded hole 318 on the beam 222 at a position corresponding to the rotational alignment feature 225 (see FIG. 7). It will be obvious to one skilled in the art that a variety of other types of mounting assembly clamping mechanisms 310 can be used in accordance with the present invention, including various spring clamp arrangements. One such alternate mounting assembly clamping mechanism 310 is shown in FIG. 16, wherein the downward force and the lateral force are separately applied by different components of the mounting assembly clamping mechanism 310. The downward force on the mounting assembly 240 is provided by means of one or more spring-biased stops 418 which contact an upper surface 238 of the mounting assembly 240 to ensure that alignment datums 250, 252 engage the top of the rod 224 (or rod segments 402). The lateral force to ensure that the alignment datums 251, 253 engage the side of the rod 224 (or rod segments 402) is provided by stacked wave disk springs 419 on shoulder bolt 420. The engagement of the shoulder of the shoulder bolt 420 against the beam 222 of the mounting rail assembly 220 ensures that excessive forces, which could distort the mounting assembly 240, are not applied to the mounting assembly 240.

In the illustrated exemplary embodiment of FIG. 10, the ink catcher 72 is attached to the frame 242 of the mounting assembly 240. The charging electrode 62 is then attached to the ink catcher 72. A shutter mechanism 352 is also attached to the frame 242 of the mounting assembly 240. The shutter mechanism is used to block the path of ink between the nozzles 50 and the print medium 32 (see FIG. 3) when the jetting module 200 is not being used to print image data. Motor 371, shaft 372, lever 373 and bar 377 are components of the shutter mechanism 352. The shutter mechanism 352 is discussed in more detail in commonly-assigned U.S. Pat. No. 9,566,798, entitled "Inkjet printhead assembly with repositionable shutter", by D. Tunmore et al., which is incorporated herein by reference.

A jetting module clamping mechanism 300 is provided for each jetting module 200. In the illustrated exemplary embodiment, the jetting module clamping mechanism 300 is a component of the mounting assembly 240. The jetting module clamping mechanism 300 applies a force to the associated jetting module 200 that causes the first alignment datum 210, the second alignment datum 211, the third alignment datum 212 and the fourth alignment datum 213 of the associated jetting module 200 to engage with the rod 224 and causes the fifth alignment datum 214 to engage with a corresponding rotational alignment feature associated with the beam 222. In the illustrated configuration, the fifth alignment datum 214 is on the bottom surface of the jetting module 200, and contacts a corresponding rotational alignment feature of the mounting assembly 240. As can be seen in FIG. 12B, the rotational alignment feature in this example is on a top surface of the ink catcher 72, which is a component of the mounting assembly 240, and will therefore have a defined positional relationship to the beam 222.

In the illustrated exemplary embodiment, the jetting module clamping mechanism 300 is a spring-loaded toggle clamp mechanism that can be operated by a human operator who is installing the jetting module 200 into the printhead assembly 190 (FIG. 6). The spring-loaded toggle clamp mechanism includes a handle 302 connected to two spring plungers 304 using a lever mechanism. When the operator lifts the handle 302, the two spring plungers 302 are pushed against corresponding surfaces of the jetting module 200, thereby pushing the jetting module against the rail assembly 220. Additional details of the spring-loaded toggle clamp mechanism can be seen more clearly in FIG. 12D.

A cross-track force mechanism 320 is also provided for each jetting module 200. In the illustrated exemplary embodiment, the cross-track force mechanism 320 is a leaf spring mechanism which is attached to the frame 242 of the mounting assembly 240. When the jetting module is inserted into the mounting assembly 240, the leaf spring applies a cross-track force on the jetting module 200 (to the right with respect to FIG. 10), which causes the sixth alignment datum 215 (see FIG. 8) to engage with a corresponding cross-track alignment feature on the beam 222. In this case, the inner surface of the second alignment tab 205 is pushed against the side face of the corresponding notch 223 in the beam 222. The cross-track force mechanism 320 also serves to apply a cross-track force on the mounting assembly 240 (to the left with respect to FIG. 10), which causes the twelfth alignment datum 255 to be pushed against the side face of the corresponding notch 223 in the beam 222, thereby engaging with a corresponding cross-track alignment feature on the beam 222. In other configurations, the cross-track force mechanism 320 can utilize other types of spring mechanisms, or can utilize any other type of force mechanisms known in the art that are adapted to provide a cross-track force (e.g., screw mechanisms, hydraulic mechanisms or toggle clamp mechanisms).

Figure 11:
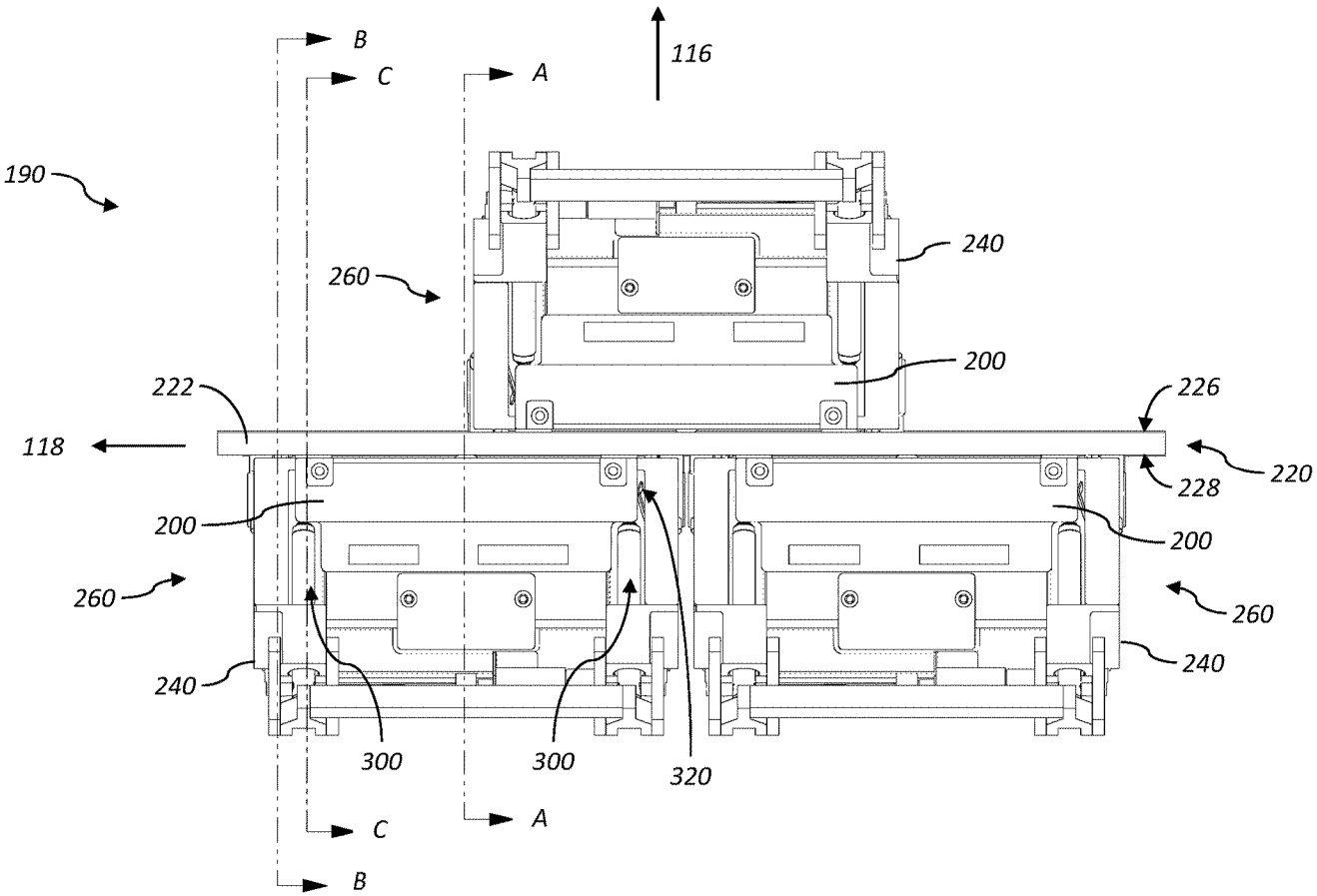
FIG. 11 shows a top view of the modular printhead assembly of FIG. 6.

FIG. 11, shows a top view of the printhead assembly 190 of FIG. 6, which includes one printhead module 260 mounted on the downstream side 226 of the rail assembly 220, and two printhead modules 260 mounted on the upstream side 228 of the beam 222. Some aspects of the various components can be seen more clearly in this view. The cut-lines are shown corresponding to the views of FIGS. 12A-12D.

Figure 12A:
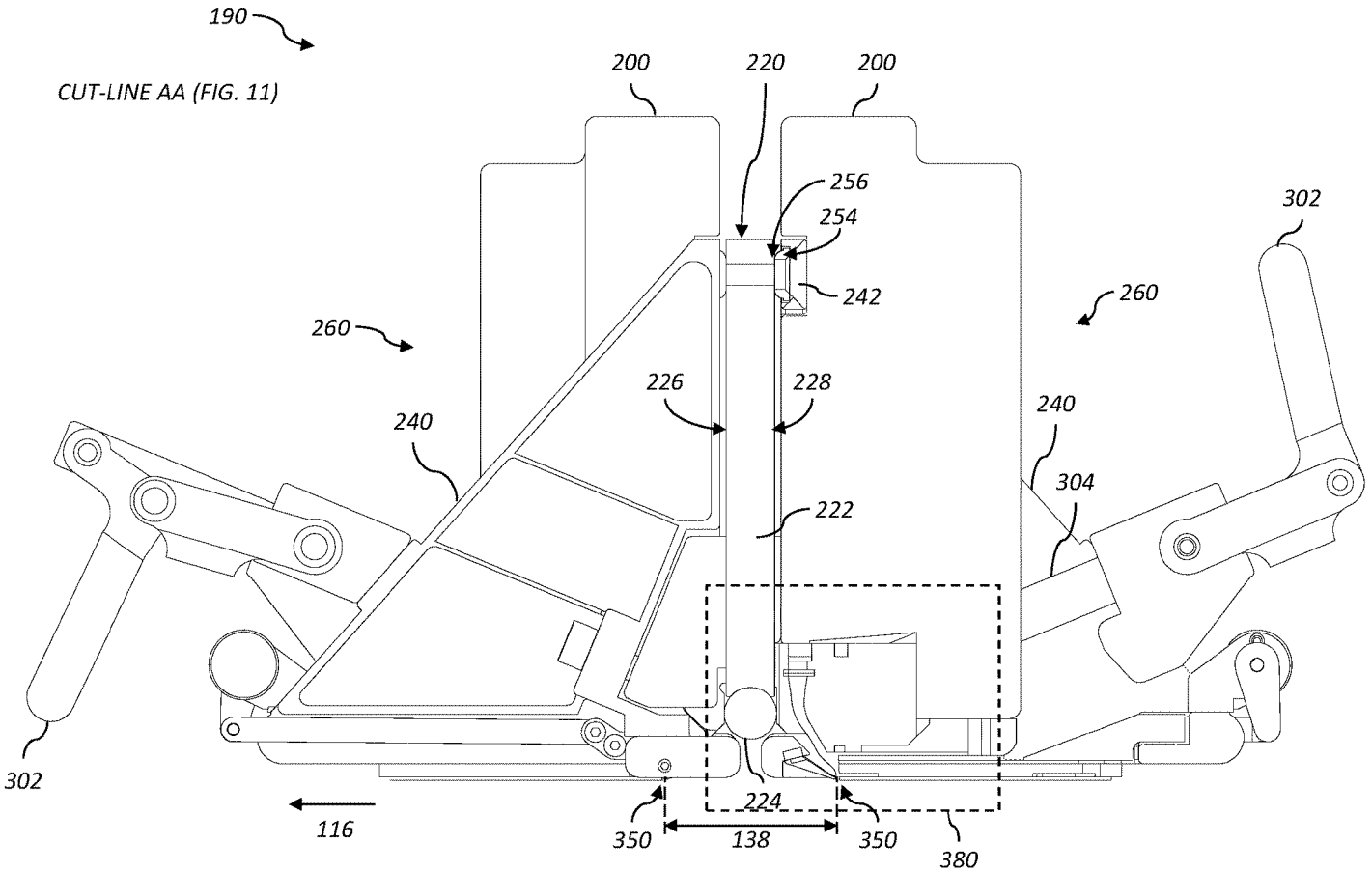
FIGS. 12A-12D show cross-section views of the modular printhead assembly of FIG. 6.
Figure 12B:
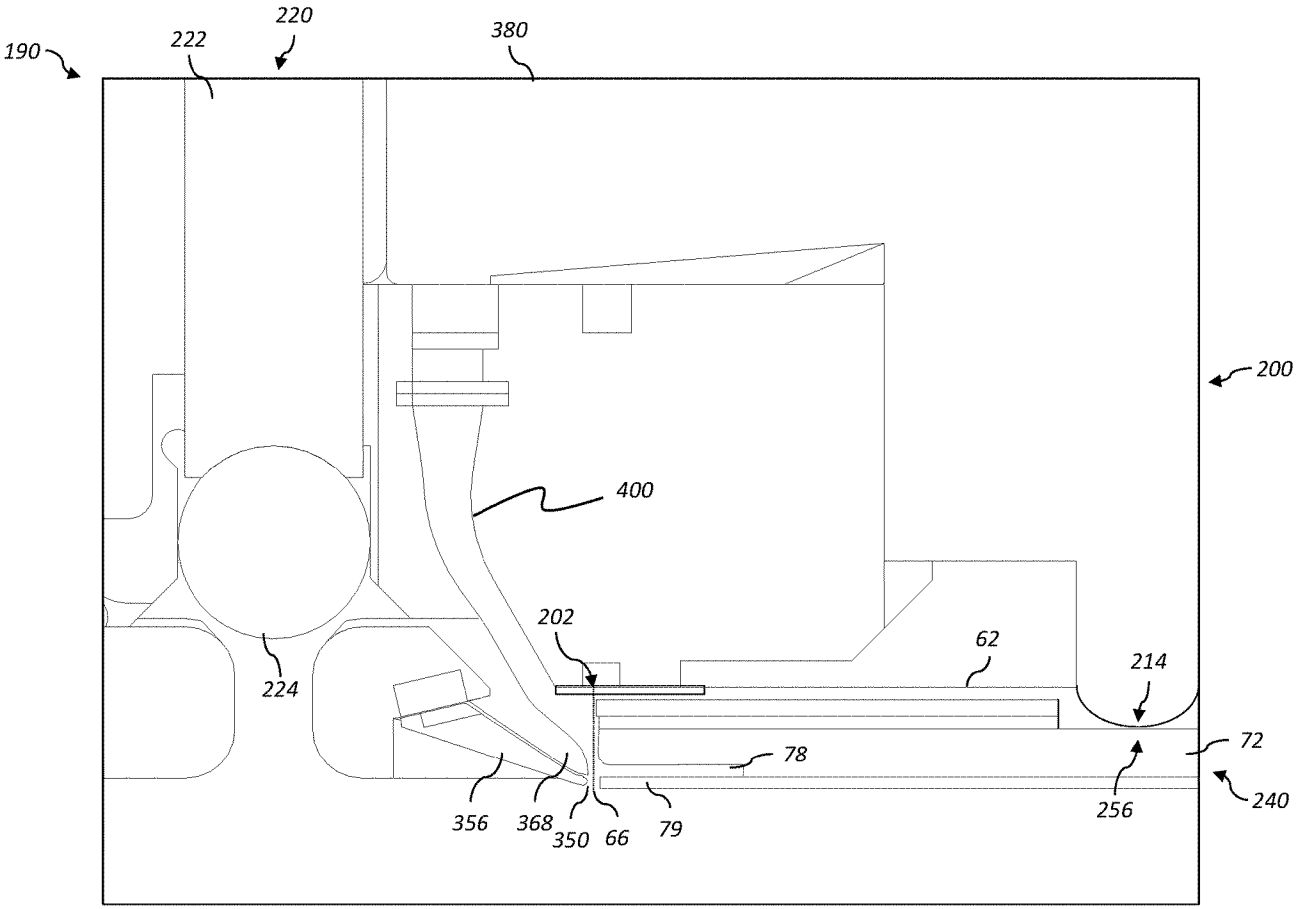

FIG. 12A corresponds to cut-line AA in FIG. 11, which passes through the center of the left-most printhead module 260. FIG. 12B is an enlarged view of the region 380 in FIG. 12A, showing additional details. A number of features of the printhead assembly 190 can be observed in these views. Slots 350 are provided in the lower surface of each printhead module 260 corresponding to the in-track positions of the nozzle arrays 202. The nozzle array spacing 138 is defined by the in-track distance between the two slots 350. As discussed earlier, it is desirable to minimize the nozzle array spacing 138 to reduce stitching errors. An advantage of the exemplary embodiment of printhead assembly 190 is that the slots 350 can be positioned quite close to the rail assembly 220. This is partially due to the fact that the ink catcher 72 is positioned upstream of the nozzle array 202 for the jetting module 200 on the upstream side 228 of the beam 222, and the ink catcher 72 is positioned downstream of the nozzle 202 array for the jetting module 200 on the downstream side of the rail assembly 220. Because the ink catchers 72 extend out a significant distance from the nozzle arrays 202, prior art system where the ink catchers 72 were all positioned on the same side of the nozzle arrays 202 required that the nozzle array spacing 138 be significantly larger.

The eleventh alignment datum 254 on the frame 242 of the mounting assembly 240 can also be seen. The mounting assembly clamping mechanism 310 (FIG. 10), pushes the alignment datum 254 into a corresponding rotational alignment feature 256 on the beam 222 of the rail assembly 220.

FIG. 12B shows an enlargement of the region 380 in FIG. 12A, and more clearly illustrates the portion of the printhead assembly 190 in the vicinity of the nozzle array 202. Undeflected printing drops 66 pass through a slot 350 formed between air guide 368 and the lower plate 79 of the ink catcher 72. Repositionable shutter blade 356 can be selectively repositioned to block the slot 350. The liquid channel 78 of the ink catcher 72 draws away non-printing drops 68 (FIG. 4) for recycling. In the illustrated configuration, the fifth alignment datum 214 of the jetting module 200 is provided by a protrusion which extends from the lower surface of the jetting module. The fifth alignment datum 214 contacts an upper surface of the ink catcher 72, which provides the rotational alignment feature 256. The ink catcher 72 is a component of the mounting assembly 240, which is mounted onto the rail assembly 220 in a predefined location, with the rotational alignment being defined relative to the beam 222 as has been discussed earlier. The rotational alignment feature 256 is therefore indirectly associated with the beam 222, even though it is not directly on the beam 222. In other embodiments, the fifth alignment datum 214 can be located in a different position on the jetting module 200. For example, the fifth alignment datum 214 can be a protrusion on the face of the jetting module that faces the beam 222. The rotational alignment feature 225 can then be a point on the beam 222, or on the frame 242 (FIG. 10) of the mounting assembly 240.

Figure 12C:
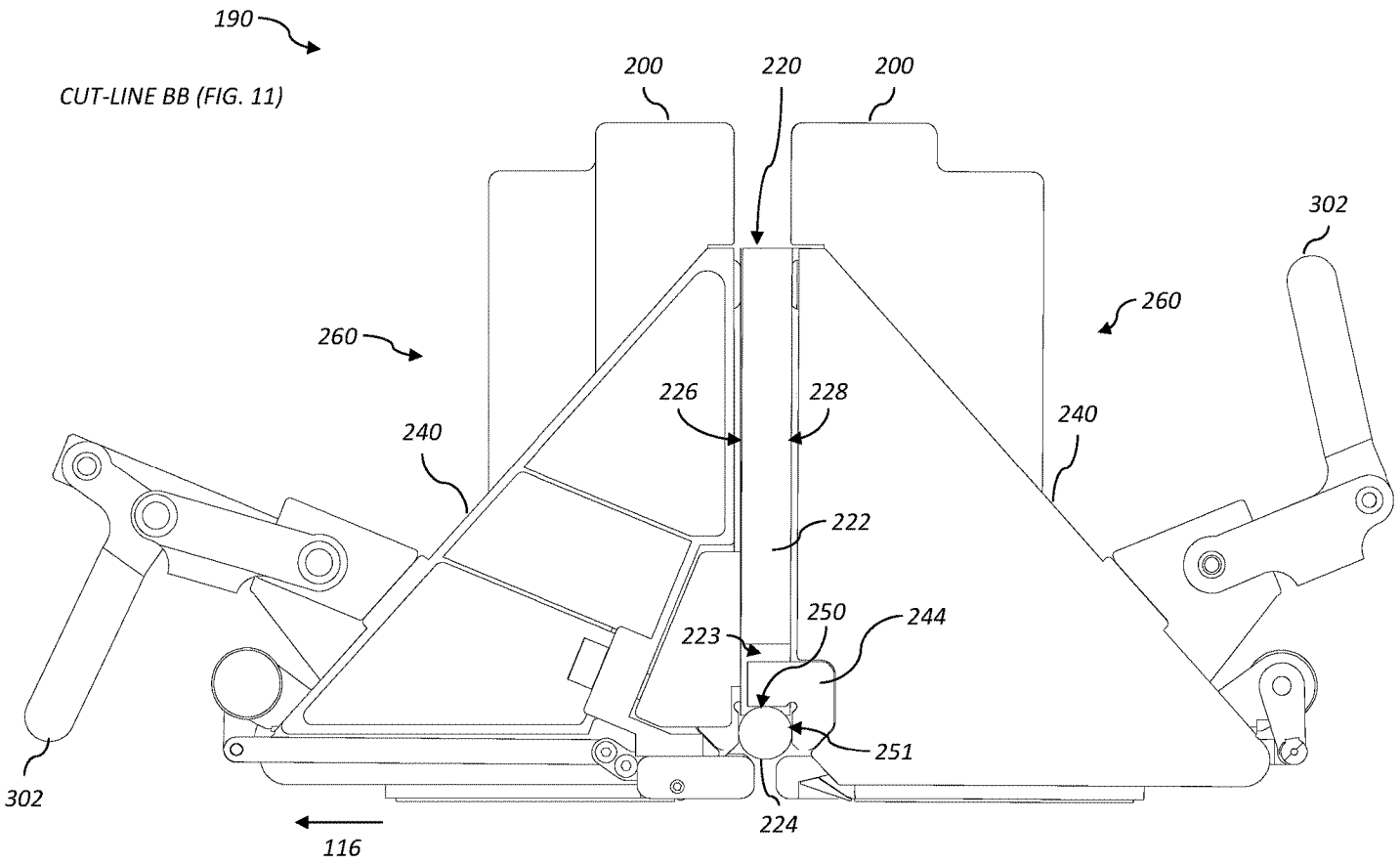

FIG. 12C corresponds to cut-line BB in FIG. 11, which passes through alignment tab 244 of the mounting assembly 240 in the left-most printhead module 260 in FIG. 11 (i.e., the upstream printhead module 260 on the right-hand side of FIG. 12C). It can be seen that the alignment tab 244 is inserted partway through the notch 223 in beam 222, and that the seventh alignment datum 250 and the eighth alignment datum 251 are in contact with the rod 224.

Figure 12D:
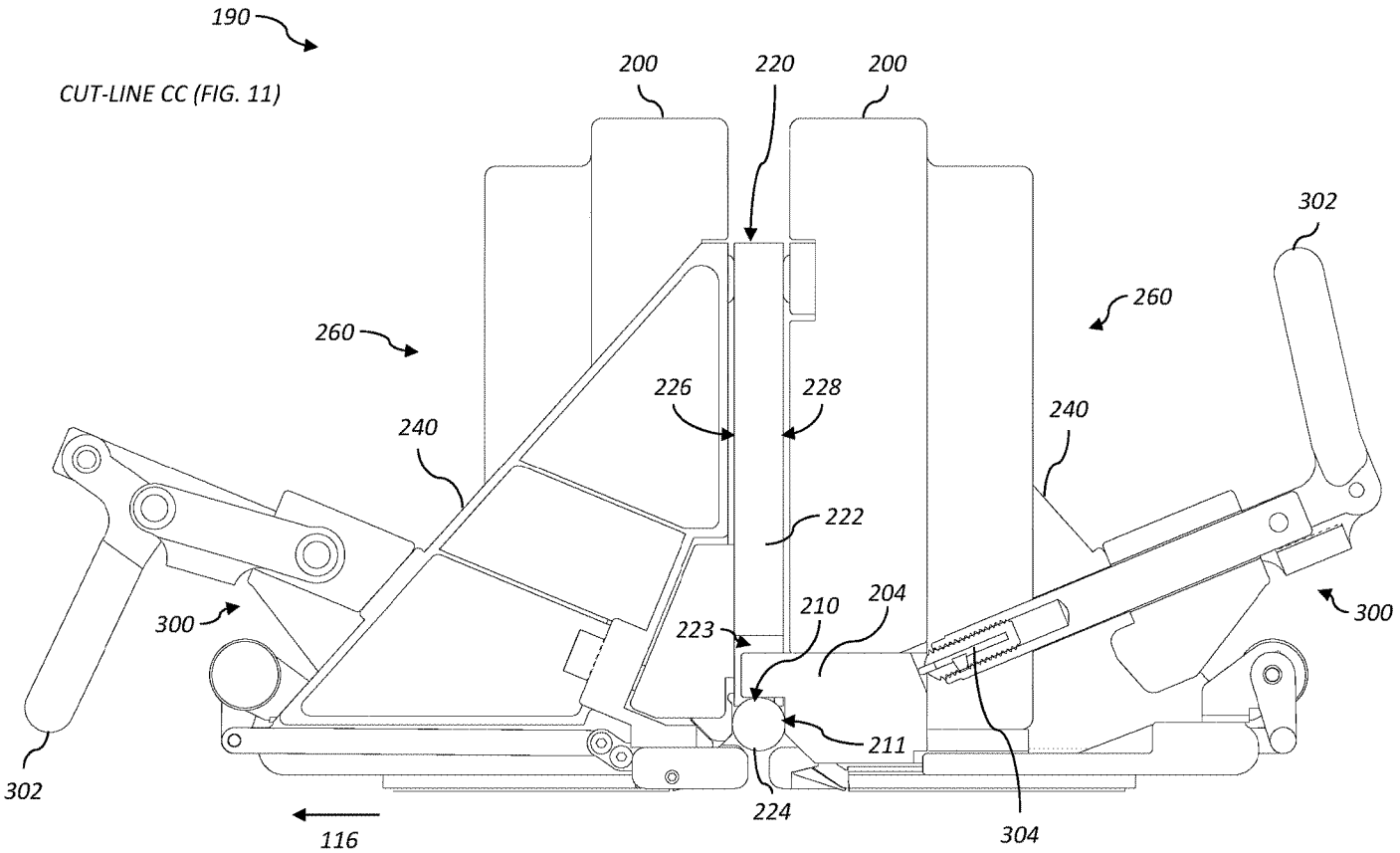

FIG. 12D corresponds to cut-line CC in FIG. 11, which passes through the alignment tab 204 of the jetting module 200 in the left-most printhead module 260 in FIG. 11 (i.e., the upstream printhead module 260 on the right-hand side of FIG. 12C). Cut-line C also passes through the spring plunger 304 of the upstream printhead module 260. The handle 302 of the jetting module clamping mechanism 300 for the upstream printhead module 260 has been pushed upward into the engaged position, so that the spring plunger 304 is applying a force onto an angled surface along one side of the jetting module 200. This pushes the alignment tab 204 of the jetting module 200 tightly against the beam 222 of the rail assembly 220. It can be seen that the alignment tab 204 is inserted partway through the notch 223 in beam 222, and that the first alignment datum 250 and the second alignment datum 251 are in contact with the rod 224. A second spring plunger 304 (not visible in FIG. 12D) is similarly applying a force onto an angled surface along the other side of the jetting module 200, thereby engaging the second alignment tab 205 with the rod 224. A downward component of the force provided by the jetting module clamping mechanism 300 also pushes downward on the jetting module 200 so that the fifth alignment datum 214 engages with the corresponding rotational alignment feature 256 on the mounting assembly 240 (as discussed with respect to FIG. 12B). The handle 302 of the jetting module clamping mechanism 300 for the downstream printhead module 260 on the left side of FIG. 12D has been pushed downward into the released position, so that the spring plungers 304 have been pulled away from the jetting module 200. This enables the jetting module 200 to be extracted from the printhead assembly 190 (e.g., for maintenance).

Figure 13A:
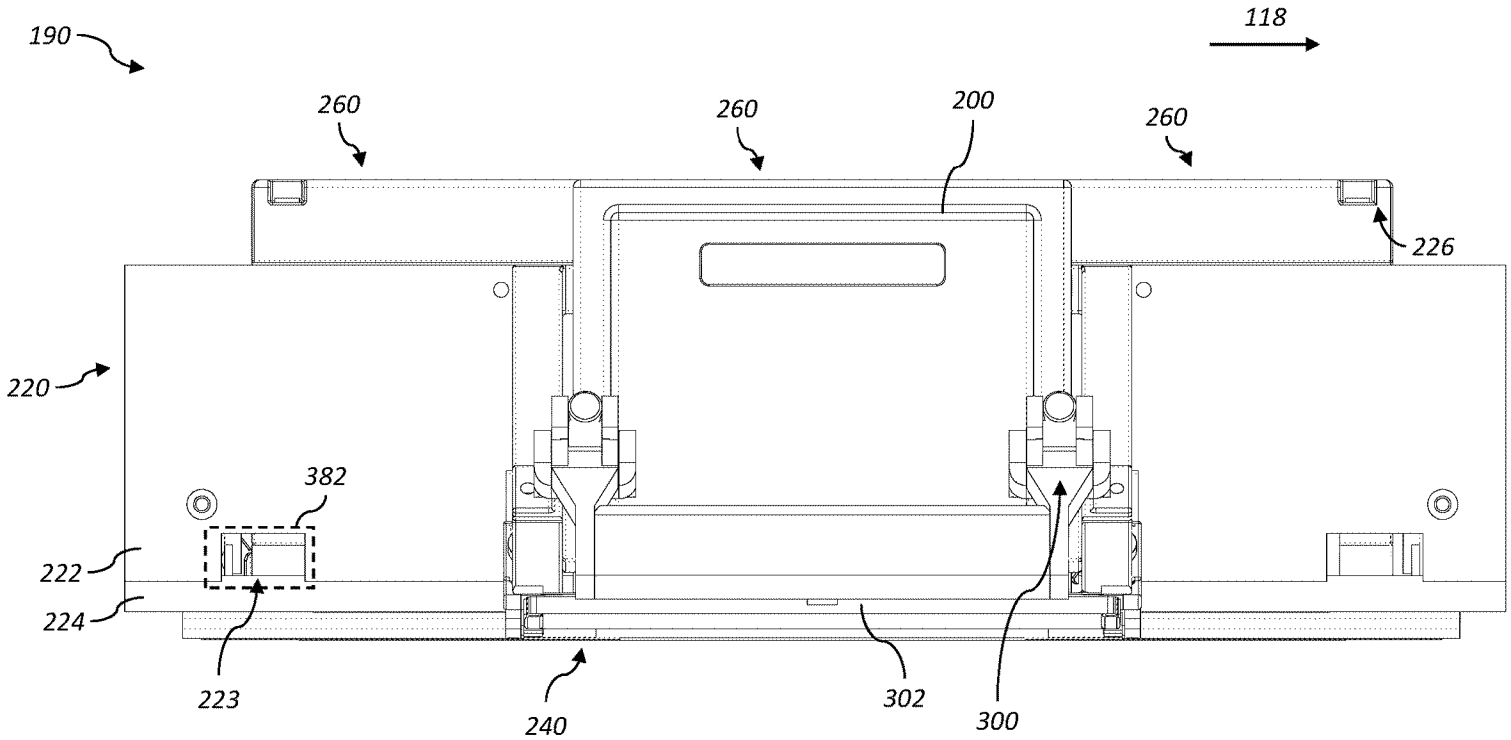
FIGS. 13A-13B show side views of the modular printhead assembly of FIG. 6.

FIG. 13A shows a side view of the printhead assembly 190 of FIG. 6 as viewed from the downstream side 226. One printhead module 260 is visible on the downstream side 226 of the rail assembly 220, with the other two printhead modules 260 being behind the rail assembly 220 on the upstream side 228 (FIG. 6).

Figure 13B:
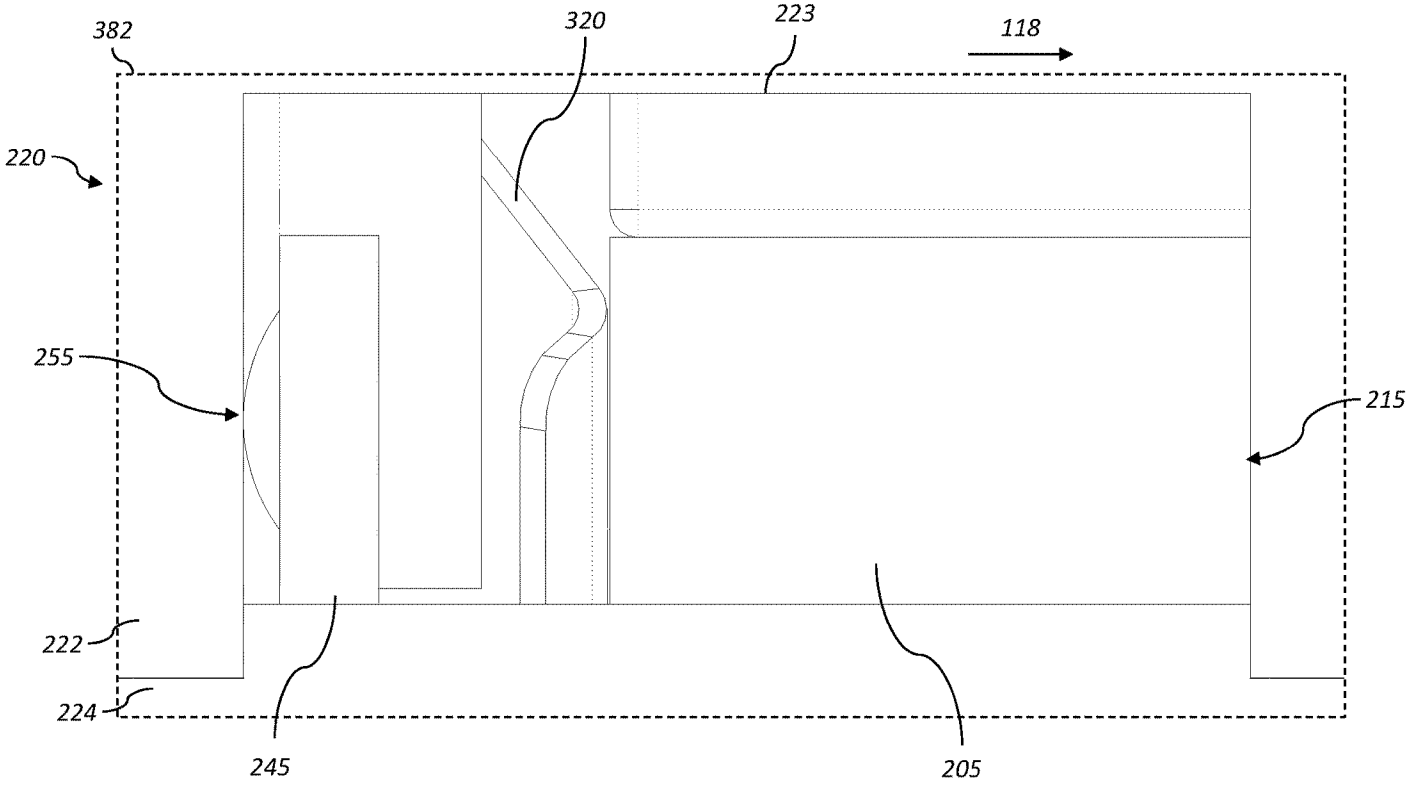

FIG. 13B shows an enlargement of the region 382 in FIG. 13A, and more clearly illustrates the portion of the printhead assembly 190 in the vicinity of the one of the notches 223 in the beam 220. Alignment tab 245 of the mounting assembly 240 (see FIG. 10) and alignment tab 205 of the jetting module 200 (see FIG. 8) in the left printhead module 260 behind the rail assembly 220 are visible within the notch 223. The leaf spring which serves as the cross-track force mechanism 320 (see FIG. 10) is visible between the alignment tabs 205, 245. The cross-track force mechanism 320 applies a cross-track force to both the mounting assembly 240 and the jetting module 200.

In the illustrated exemplary embodiment, the cross-track force mechanism 320 pushes the mounting assembly 240 to the left so that the alignment datum 255 on the outer face of the alignment tab 245 contacts the left face of the notch 223, which serves as the corresponding cross-track alignment feature associated with the beam 222. As discussed earlier, in other embodiments, other features on the mounting assembly 240 can serve as the alignment datum 245.

Similarly, in the illustrated exemplary embodiment, the cross-track force mechanism 320 pushes the jetting module 200 to the right so that the alignment datum 215 on the inner face of the second alignment tab 205 contacts the right face of the notch 223, which serves as the corresponding cross-track alignment feature associated with the beam 222.

In other embodiments, other features on the jetting module 200 can serve as the alignment datum 215. For example, the alignment datum 215 can be on outer face of the first alignment tab 204. As the cross-track force mechanism 320 pushes the jetting module 200 to the right, the spacing between the alignment tabs 204, 205 and the spacing between the alignment tabs 244, 245 can be arranged such that the outer face of the first alignment tab 204 comes into contact with the inner face of the third alignment tab 244 (see FIG. 10) on the mounting assembly 240. In this case, the inner face of the alignment tab 244 serves as the corresponding cross-track alignment feature associated with the beam 222. Since the mounting assembly 240 is mounted onto the rail assembly 220 in a predefined location, with the cross-track alignment being defined relative to the beam 222 as has been discussed earlier, the cross-track alignment feature on the alignment tab 244 is therefore indirectly associated with the beam 222, even though it is not directly on the beam 222.

As the printing drops 66 pass through the air on their way to the print medium 32 in FIG. 3, they are affected by varying amounts of air drag. The air drag on a printing drop 66 depends in part on the spacing between the print drop and the preceding printing drop. The varying amounts of air drag encountered by the printing drops can produce dot placement artifacts on the print medium; such dot placement artifacts are referred to as air drag artifacts. As the printing drop size has been reduced to provide for higher print resolutions, the magnitude of the air drag artifacts tends to increase. As noted in U.S. Pat. No. 3,596,275, such air drag artifacts can be substantially reduced by introducing an air flow within the printhead that surrounds the printing drops and that flows parallel or collinear to the printing drop trajectories. Preferably, the collinear air flow has a velocity in the vicinity of the printing drops of at least one half the printing drop velocity and up to the printing drop velocity.

In the printhead shown in FIG. 12B, the collinear air flow can be provided through air flow duct 400. While the collinear air flow through this duct reduces the magnitude of air drag artifacts, the air flow duct configuration was found to have some deficiencies. First, it was found that the air flow duct and plenum did not adequately distribute the air flow across the width of the nozzle array. Higher air flow velocities were found near the center of the nozzle array due to the central placement of the air supply port to the air flow duct. It was also found that air passing through the filter and screen, which were located within the air flow duct to aid in distributing the air flow, formed high speed jets of air downstream of the filter and screen. These jets of high velocity air produced highly localized variations in air velocity adjacent to the print drops, which in turn produced localized variations in the air drag artifacts across the array. The air flow duct deficiencies are due in part to the limited available space for the air flow duct between the jetting module and the mounting rail assembly, which limits the width of the air flow duct 400 as viewed in the cross section of FIG. 12B.

Figure 14:
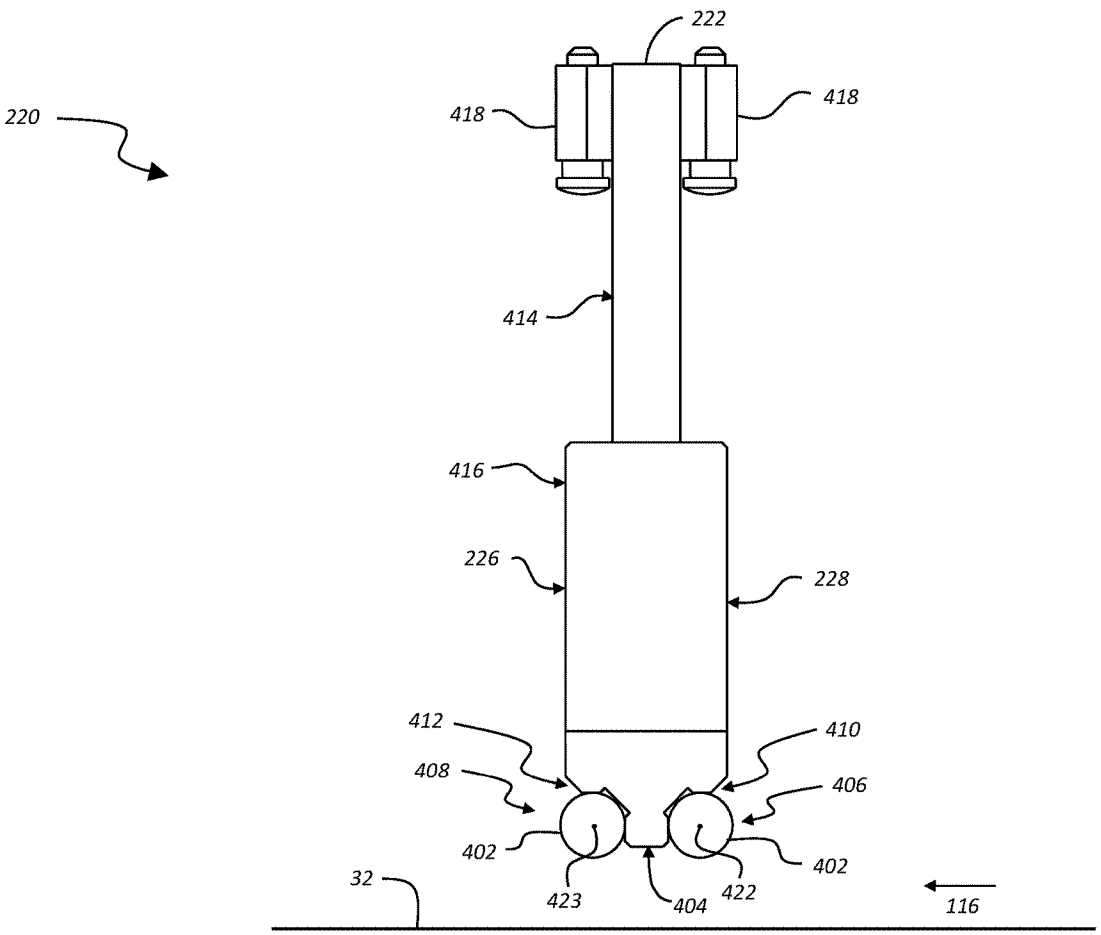
FIG. 14 shows a side view a rail assembly including upstream and downstream sets of rod segments according to an exemplary embodiment.
Figure 15:
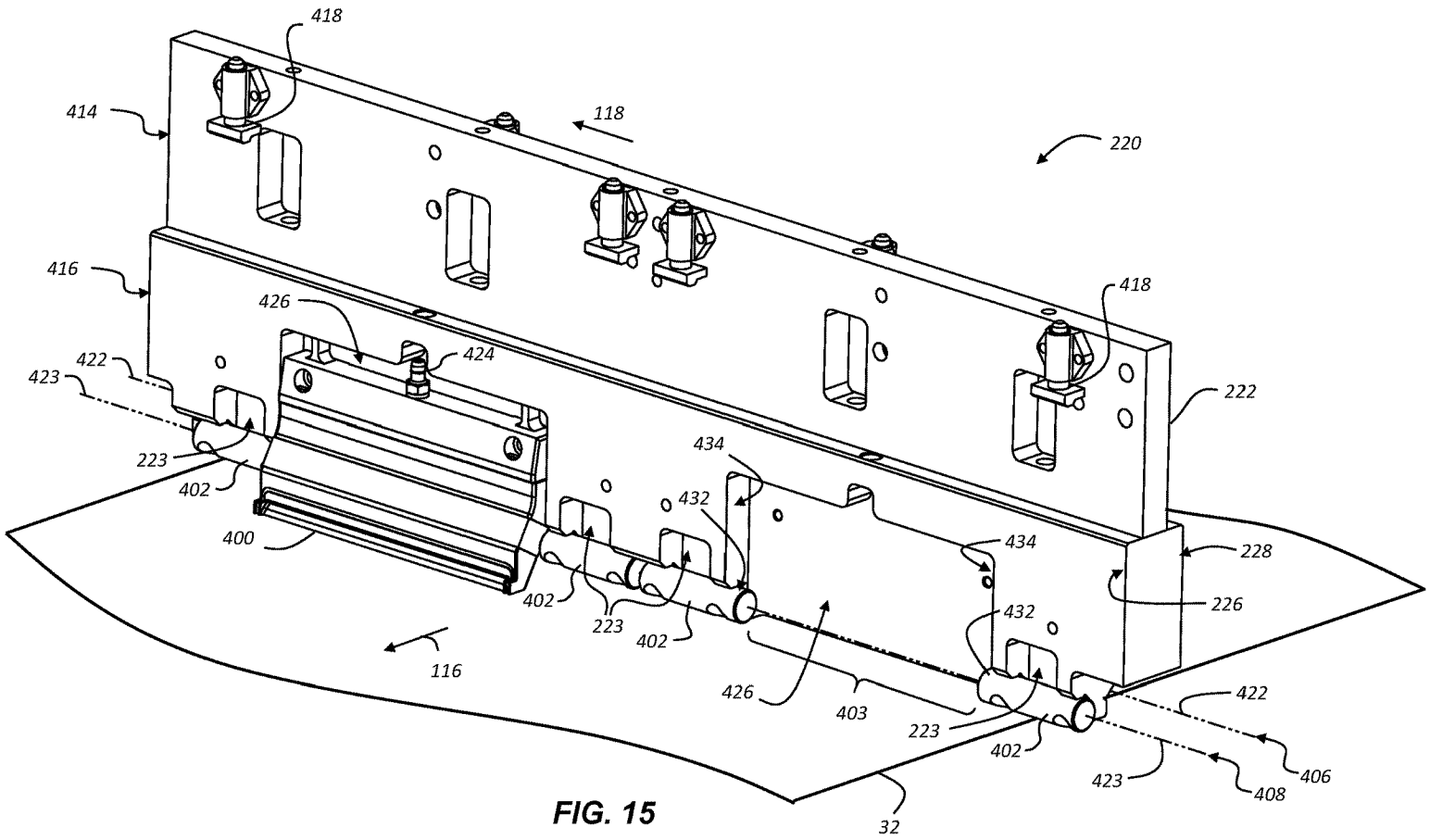
FIG. 15 shows an isometric view of the rail assembly of FIG. 14.

FIGS. 14 and 15 shows a side view and an isometric view, respectively, of an embodiment of the mounting rail assembly 220 that provides additional space for the air flow duct 400. This embodiment uses two sets of rod segments 402 attached in proximity to the print-medium-facing side 404 of the beam 222 of the rail assembly 220 (i.e., the side of the beam 222 that faces the print medium 32). The print medium 32 moves in the in-track direction 116 from upstream to downstream. One set of rod segments 402, referred to as an upstream set 406 of rod segments 402, are attached in proximity to an upstream edge 410 of the beam, the upstream edge 410 being the edge where the upstream side 228 of the beam 222 intersects the print-medium-facing side 404 of the beam. The second set of rod segments 402, referred to a downstream set 408 of rod segments 402, are attached in proximity to the downstream edge 412 of the beam; the downstream edge 412 being where the downstream side 226 of the beam and the print-medium-facing side 404 of the beam intersect. The upstream edge 410 and the downstream edge 412 may be filleted, chamfered, or otherwise contoured to facilitate the alignment and attachment of the rod segments 402 in proximity to the respective edges.

The rod segments 402 of the upstream set 406 are collinearly aligned with each other, sharing a common axis 422. Similarly, the rod segments 402 of the downstream set 408 are collinearly aligned with each other, sharing a common axis 423. The axis 422 of the upstream set 406 of rod segments 402 is parallel to the axis 423 of the downstream set 408 of rod segments 402. In an exemplary configuration, the rod segments 402 have a cylindrical shape around at least a portion of their circumference. In some configurations, some portion of the rod segments 402 can have a different shape (e.g., a flat surface), for example to facilitate attachment to the beam 222.

Figure 17:
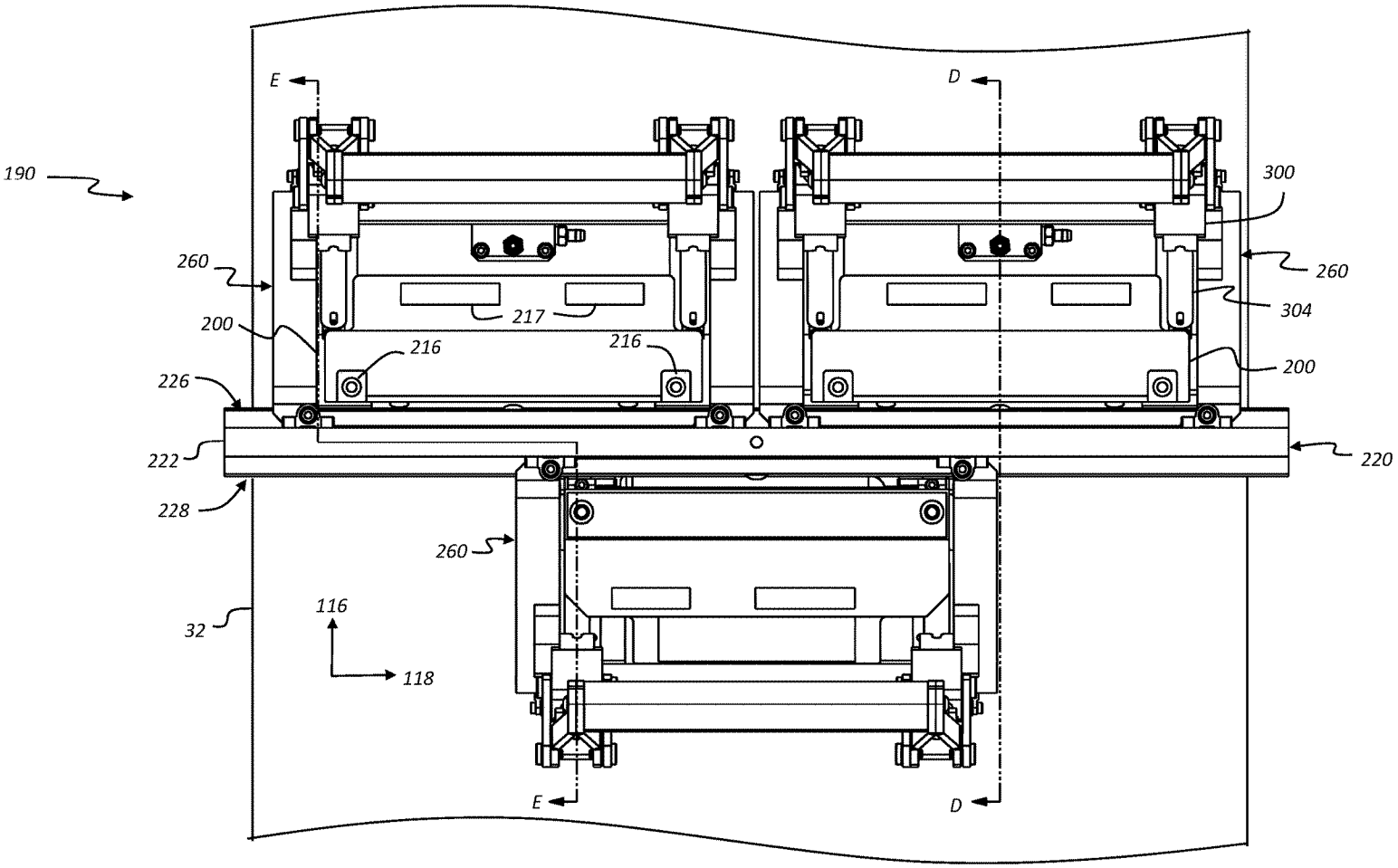
FIG. 17 show a top view of the printhead assembly of FIG. 16.
Figure 18:
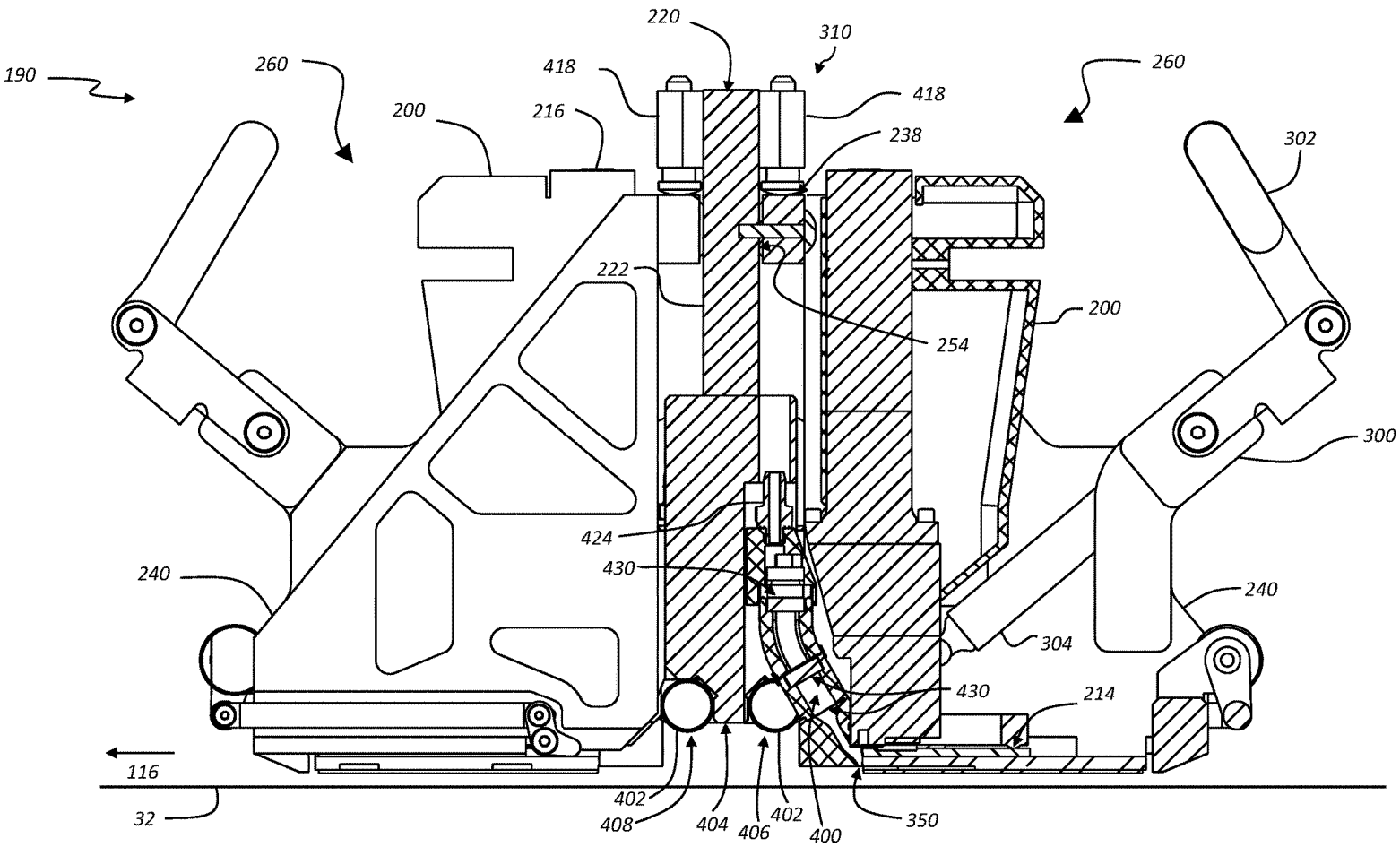
FIG. 18 show another cross-sectional view of the printhead assembly of FIG. 16.

As shown in the cross-sectional views of FIGS. 16 and 18, and the top view of FIG. 17, a plurality of printhead modules 260 are mounted to the mounting rail assembly 220, with at least one printhead module 260 attached to mounting rail assembly 220 on the upstream side 228 of the beam 222 and at least one printhead module 260 attached to mounting rail assembly 220 on the downstream side 226 of the beam 222. (FIG. 17 shows the cut-line DD used in the cross-sectional view of FIG. 16 and the cut line EE used in the cross-sectional view of FIG. 18.) In the illustrated configuration, each of the printhead modules 260 engages the rail assembly 220 at different cross-track positions in the cross-track direction 118. In other configurations, one or more pairs of printhead modules 260 can be mounted on opposite sides of the mounting rail assembly 220 at the same cross-track position.

Each of the plurality of printhead modules 260 includes a corresponding jetting module 200, with each jetting module 200 having an array of nozzles extending in the cross-track direction 118. (In the cross-sectional view of FIG. 16, the jetting module 200 of the downstream printhead module 260 is visible, but due to the placement of the cross-section cut line, the jetting module 200 of the upstream printhead module 260 is not visible.) Although some of these features are not visible in FIGS. 16-17, each jetting module 200 includes a first alignment tab 204 having a first alignment datum 210 and a second alignment datum 211 and a second alignment tab 205 having a third alignment datum 212 and a fourth alignment datum 213, the second alignment tab 205 being spaced apart from the first alignment tab 204 in the cross-track direction, as discussed earlier with respect to FIG. 8. The jetting modules 200 also include a rotational alignment feature 256 including a fifth alignment datum 214 and a cross-track alignment feature including a sixth alignment datum 215 as discussed previously.

A jetting module clamping mechanism 300 corresponding to each jetting module 200 applies a force to the associated jetting module 200 that causes the first alignment datum 210, the second alignment datum 211, the third alignment datum 212 and the fourth alignment datum 213 of the associated jetting module 200 to engage with a corresponding rod segment 402 and causes the fifth alignment datum 214 of the associated jetting module 200 to engage with a corresponding rotational alignment feature associated with the beam 222. In a preferred embodiment, the jetting module clamping mechanism 300 is a portion of the corresponding printhead module 260. In an alternate embodiment, the jetting module clamping mechanism 300 can be attached to the mounting rail assembly 220 rather than to the printhead module 260. As discussed previously, a jetting module cross-track force mechanism 320 (e.g., see FIG. 13B) for each jetting module 200 applies a cross-track force to the associated jetting module 200 that causes the sixth alignment datum 215 of the associated jetting module 200 to engage with a corresponding cross-track alignment feature associated with the beam 222.

The use of two sets of rod segments 402 on the rail assembly 220 allows a thicker beam 222 to be used to increase the rigidity of the mounting rail assembly 220. The thicker beam 222 has sufficient rigidity to allow recessed pockets 426 to be formed in the upstream side 228 and the downstream side 226 of the beam; the recessed pockets 426 being aligned with the location of printhead modules 260. In the illustrated embodiment, the air flow ducts 400 are mounted onto the rail assembly 220 (e.g., an airflow duct 400 is shown mounted in the left recessed pocket 426 in FIG. 15). In other embodiments, the air flow ducts 400 can be mounted to the printhead modules 260 such that they will fit within the recessed pockets 426 when the printhead modules 260 are mounted onto the rail assembly 220. By locating at least, a portion of the air flow duct 400 within the recessed pocket 426, the cross-sectional width W in the in-track direction 116 of the air flow duct 400 can be increased significantly (see FIG. 18) when compared to the air flow duct 400 of a printhead module 260 mounted to a mounting rail 220 assembly having a single rod 224 (see FIG. 12A). Some embodiments of the air flow duct 400 associated with a printhead module 260 include alignment datums similar to the alignment datums of the mounting assembly 240 or of the jetting module 200 of the printhead module 260 for engaging the rod segments 402. With such alignment datum, the air flow duct 400, the mounting assembly 240, and the jetting module 200 are all aligned by engagement with the same set of rod segments 402.

In the embodiment of FIGS. 14-18, further space is provided for the air flow duct 400 by using the two sets of rod segments 402. The upstream set 406 is used for the alignment of the upstream printhead modules 260 and the downstream set 408 are used for the alignment of the downstream printhead modules 260. The upstream set 406 and the downstream set 408 each include a plurality rod segments 402 (see FIG. 15). A pair of rod segments 402 used for aligning a particular printhead module 260 are located adjacent to the recessed pocket 426 associated with the printhead module 260 such that the recessed pocket 426 associated with a printhead module 260 is positioned in a gap 403 between the adjacent rod segments 402. To facilitate the alignment of the air flow duct 400 using these rod segments 402, a portion 432 of the rod segments 402 can extend past side edges 434 of the recessed pockets 426 for engagement with the alignment datums of the air flow duct 400. In other embodiments, not shown, one or both the upstream set 406 and the downstream set 408 of rod segments 402 can consist of a single rod segment 402 that spans the width of the respective upstream or downstream set of printhead modules 260.

Figure 19:
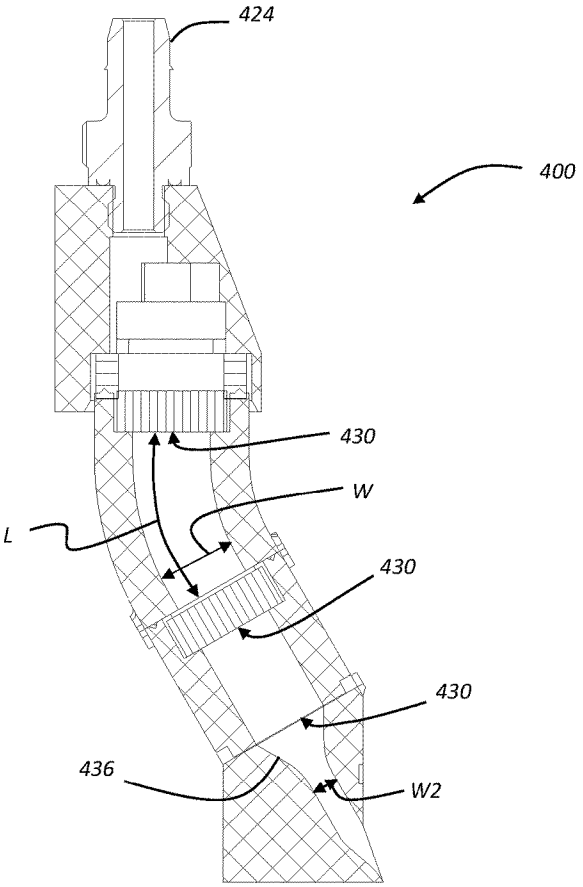
FIG. 19 shows a cross-sectional view of an air flow duct according to an exemplary embodiment.

As shown in more detail in FIG. 19, in a preferred embodiment, the air flow duct 400 includes one or more flow restrictors 430 that each span the air flow duct 400. Flow path restrictors 430 helps to more uniformly distribute the gas flow and ensure that the velocity vectors of the gas remain pointed in the proper direction. As the gas passes through each flow restrictors 430, the gas flow is divided into a flow component perpendicular to flow restrictor 430 and another flow component parallel to flow restrictor 430 which is effectively zero. This changes a non-laminar or turbulent flow of gas at the inlet port 424 of the air flow duct 400 into a substantially laminar flow of gas as it exits air flow duct 430. Laminar gas flow provided through the air flow duct 400, leaves the printhead module through slot 350 (see FIG. 18), flowing substantially parallel to the printing drops 66 (see FIG. 3). Within the context of the present disclosure "substantially parallel" means that the airflow exiting through the slot 350 is within 10 degrees of parallel to the printing drop trajectory. The collinear air flow provided through the air flow duct 400, helps to reduce air drag artifacts in the print.

In an exemplary configuration, the flow restrictors 430 are made of a porous material, such as a woven screen or mesh, either wire, metal, or polymer (plastic). The pores can be located at regular intervals or can be randomly placed provided that the porosity is relatively uniform across the air flow duct 400. Fine screen or mesh pores reduce the turbulence more than coarser screen or mesh pores. When used as flow restrictors 430, the screen or mesh pores are typically finer than the pitch of the jets. In the exemplary embodiment of FIGS. 18-19, three flow restrictors 430 are used, where the first two flow restrictors 430 (i.e., the ones closest to the entry port 424) are polymeric filter elements with a 5-10 micron pore size and the third flow restrictor 420 is an approximately planar woven mesh screen having 500 to 600 lines per inch.

Alternatively, other suitable flow restrictor devices or structures, for example, porous plates, foams, and felts, can be used provided they do not cause too large of a pressure drop across the flow restricting device (which reduces the velocity of the gas flow) and do not shed particles (which can cause drop stream to be misdirected or which can produce electrical shorting of the charge electrode voltage). Typically, the type of flow restricting device and material selection depends on the specific application contemplated.

Preferably, the one or more flow restrictors 430 are located within the air flow duct 400 at a position in which the air flow duct is expanded to its ultimate depth; the depth direction being parallel to the nozzle array. As discussed in commonly-assigned U.S. Pat. No. 8,091,992 (Hancheck), entitled "Deflection device including gas flow restriction device," which is incorporated herein by reference, the first two flow restrictors 430 are preferably spaced out by a distance L, which is between one to two times the air flow duct width W, the width direction being perpendicular to the air flow direction and perpendicular to the depth direction. Additionally, the one or more flow restrictors 430 are located within the air flow duct at a position upstream of the narrowing 436 of the width of the air flow duct 400. Such a placement of the flow restrictors 430 uniformly distributes the air flow across the air flow duct 400, and minimizes the overall pressure drop produced by the flow restrictors 430. Preferably, the air flow duct width W upstream of the narrowing 436 of the air flow duct 400 is greater than 3× the air flow duct width W2 downstream of the narrowing of the air flow duct 400. Such a ratio of widths W and W2 helps to keep the air flow velocity low upstream of the duct narrowing, which helps to dissipate any turbulence in the air flow.

In the embodiments of the beam portion of the rail assembly 220 shown in FIGS. 14-18, an upper portion 414 of the beam is narrower in the in-track direction 116 than a lower portion 416 of the beam 222. In other embodiments, the upper and lower portions 414, 416 of the beam 222 have the same width in the in-track direction 116. In some embodiments, the upper and lower portions 414, 416 of the beam 222 are separate components at are bolted or otherwise secured to each other. In other embodiments, the upper and lower portions 414, 416 of the beam 222 are a single monolithic structure. Preferably, the upper and lower portions 414, 416 of the beam 222 and the rod segments 402 all have similar thermal expansion coefficients to minimize thermally induced distortions to the rail assembly 220.

Figure 20:
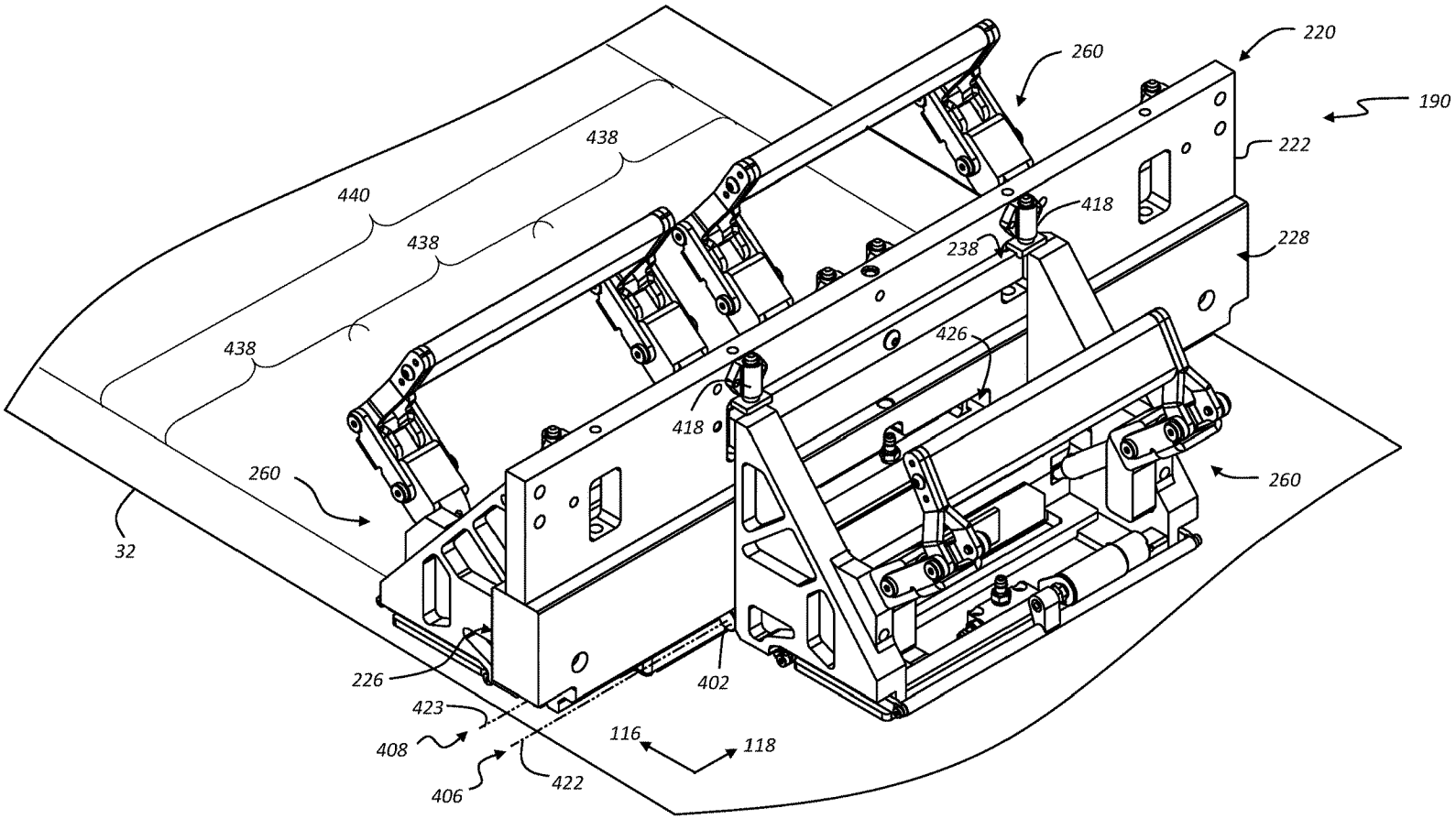
FIG. 20 show an isometric top view of a printhead assembly with a mounting rail assembly and attached upstream and downstream printhead modules at different cross-track positions according to an exemplary embodiment.

FIG. 20 is an isometric view of a printhead assembly 190, with one printhead module 260 mounted on the upstream side 228 of the rail assembly 220, and two printhead assemblies 260 mounted on the downstream side 226 of the rail assembly 220. The printhead modules 260 are each mounted to the rail assembly at different cross-track positions in the cross-track direction 118, in a manner that allows the print swaths 438 of the three printhead modules 260 to be printed side by side with some amount of overlap. Various stitching algorithms such as are known in the art can be used to stitch the swaths together to provide a print band 440 that spans the nozzle array widths of all three printhead modules 260.

Figure 21:
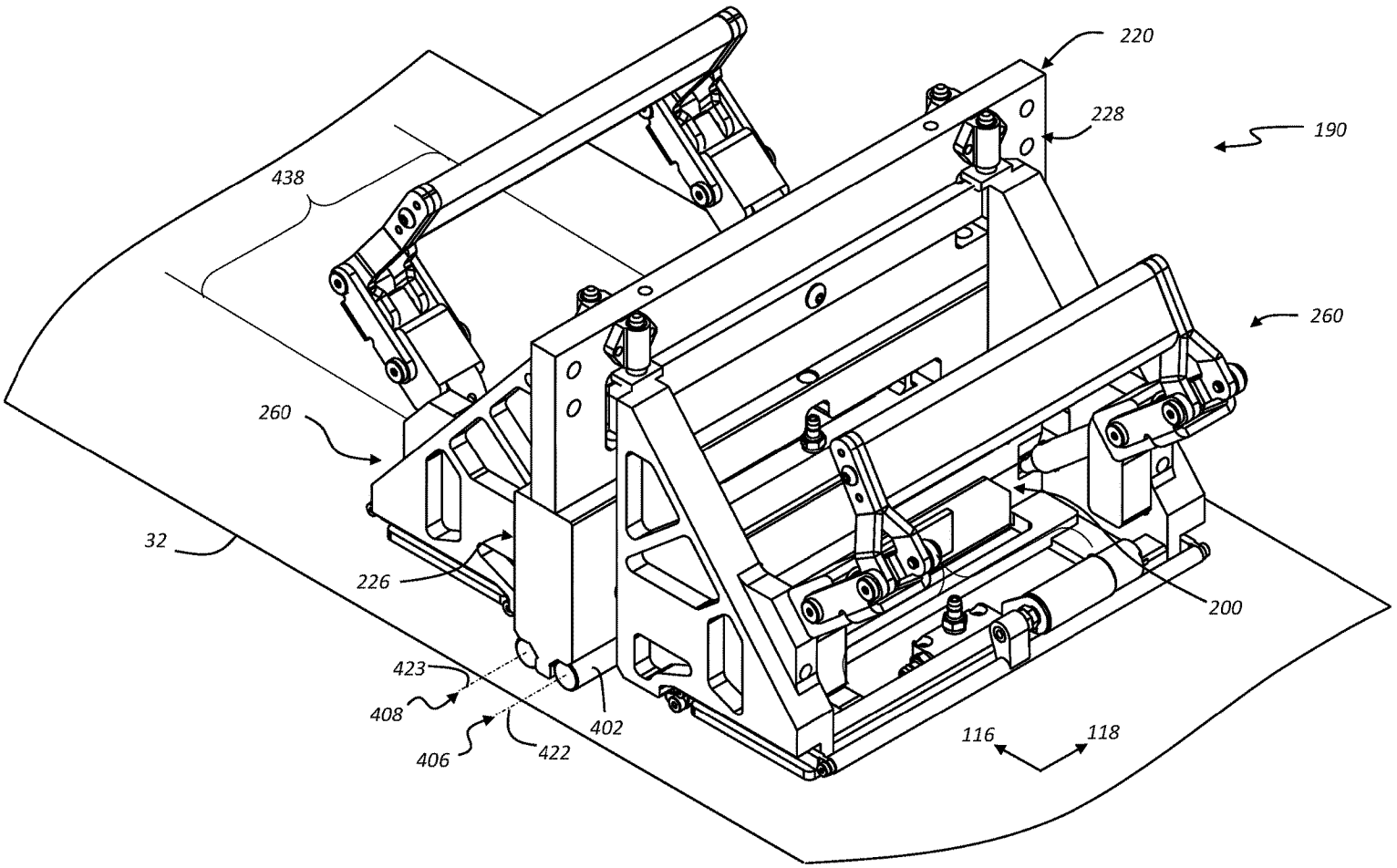
FIG. 21 show an isometric top view of a printhead assembly with a mounting rail assembly and attached upstream and downstream printhead modules at the same cross-track position according to another exemplary embodiment.
Figure 22:
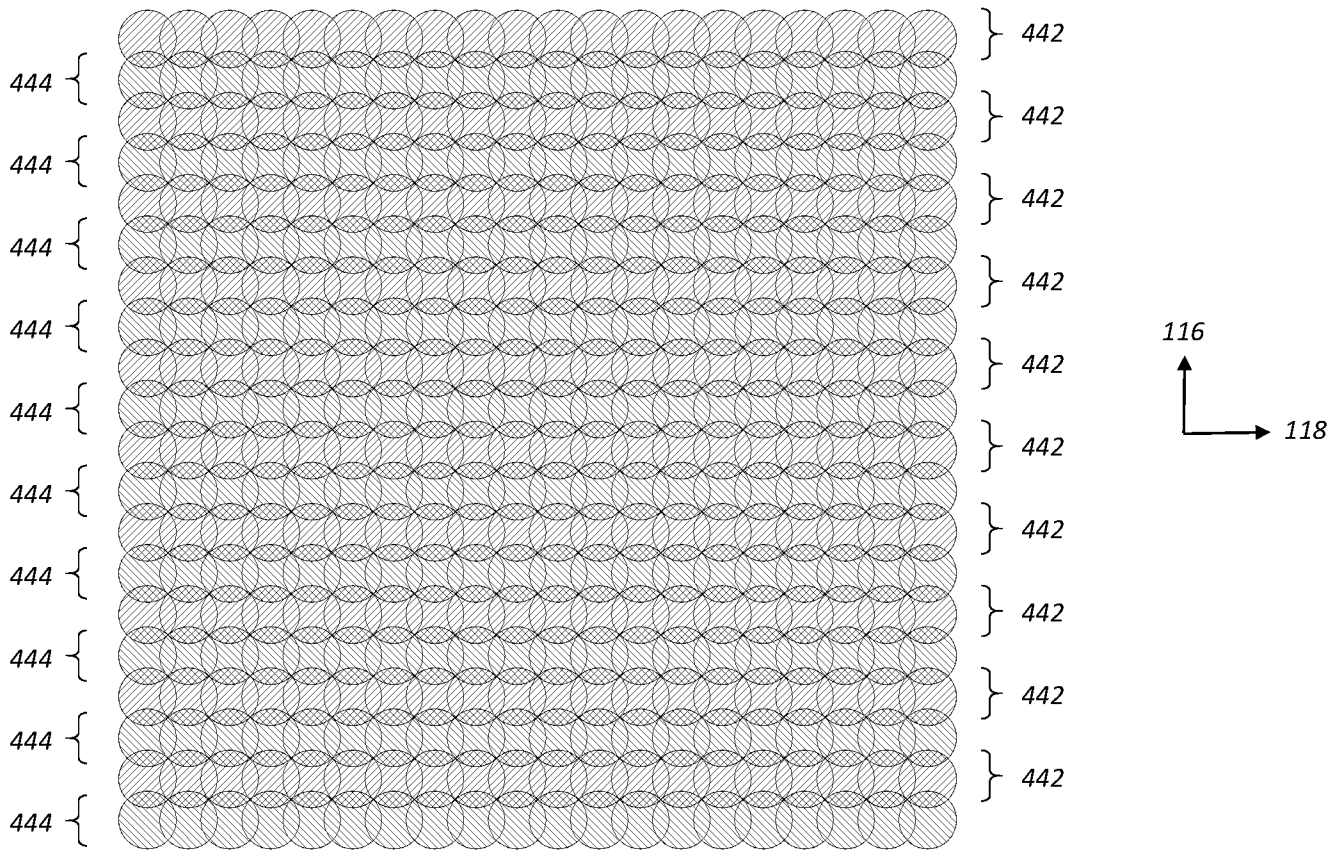
FIG. 22 show a pattern of pixels printed by an upstream printhead module and a downstream printhead module, in which the interleaving is in the in-track direction.

FIG. 21 shows another embodiment of a printhead assembly 190, in which one printhead module 260 is attached to the mounting rail assembly 220 on the upstream side 228 of the beam 222 and one printhead module 260 is attached to mounting rail assembly 220 on the downstream side 226 of the beam 222. Each of the printhead modules 260 includes a jetting module 200. The upstream and the downstream jetting modules 200 in this configuration engage the rail assembly 220 at the substantially the same cross-track position in the cross-track direction 118. This configuration is useful for applications where it is desirable to print a single swath 438 using two printhead modules 260. These applications include printing the swath 438 with two colors of ink; typically, the two colors would include black ink along with one spot color. Alternatively, for full process color applications, two mounting rail assemblies 220, each with an upstream and a downstream printhead module 260, would be used with a second mounting rail assembly 220 positioned downstream of a first mounting rail assembly 220, not shown. In this case, each of the of the four printhead modules 260 would print with a separate one of the primary colors of ink.

Figure 23:
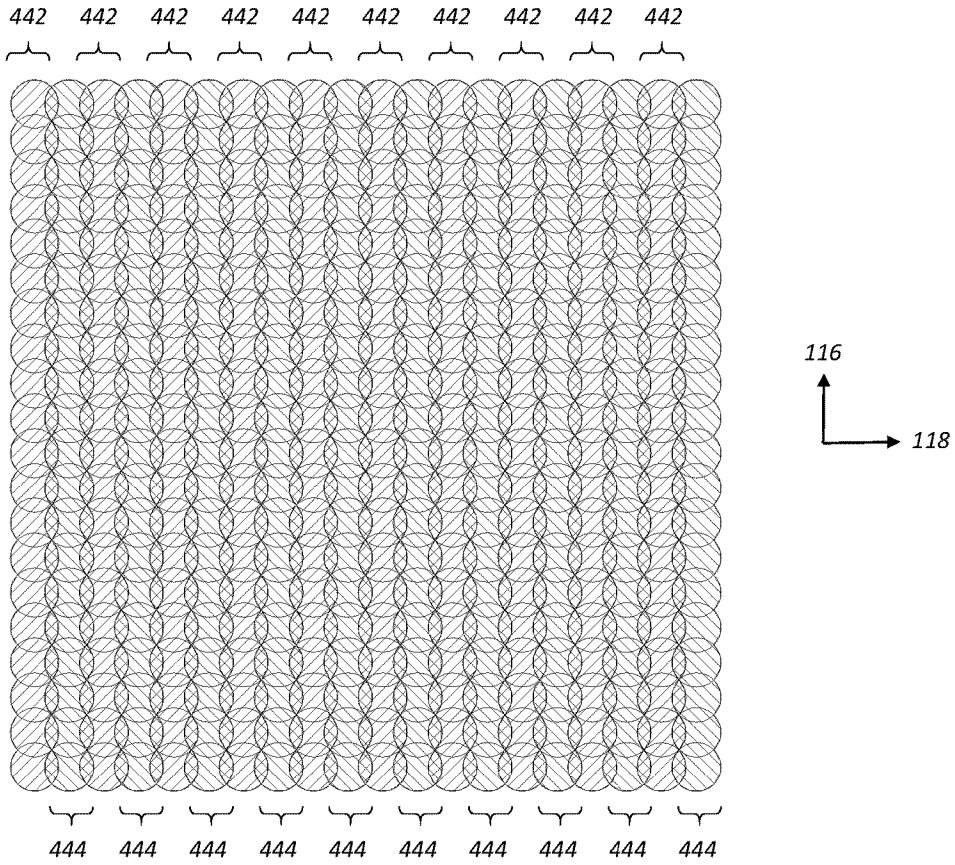
FIG. 23 show a pattern of pixels printed by an upstream printhead module and a downstream printhead module, in which the interleaving is in the cross-track direction.

In other applications, both the upstream and downstream printhead modules 260 would print with the same color ink, but the upstream printhead pixels 442 printed by upstream printhead module 260 would be interleaved with the downstream printhead pixels 444 printed by the printhead module 260. In one such application the pixels of the two printhead modules 260 would be interleaved with each other in the in-track direction 116, as shown in FIG. 21. This interleaving can enable the printing system to print at twice the print speed of a single printhead printing system. Alternatively, the pixels of the two printhead modules 260 can be interleaved with each other in the cross-track direction 118 to double the cross-track resolution of the printing system, as shown in FIG. 23. The close spacing between the nozzle arrays of the upstream and the downstream printhead modules 260 reduces the risk of registration shifts between the patterns printed by the printhead modules 260 mounted on the upstream side 228 and the downstream side 226 of the mounting rail assembly 220.

Figure 24:
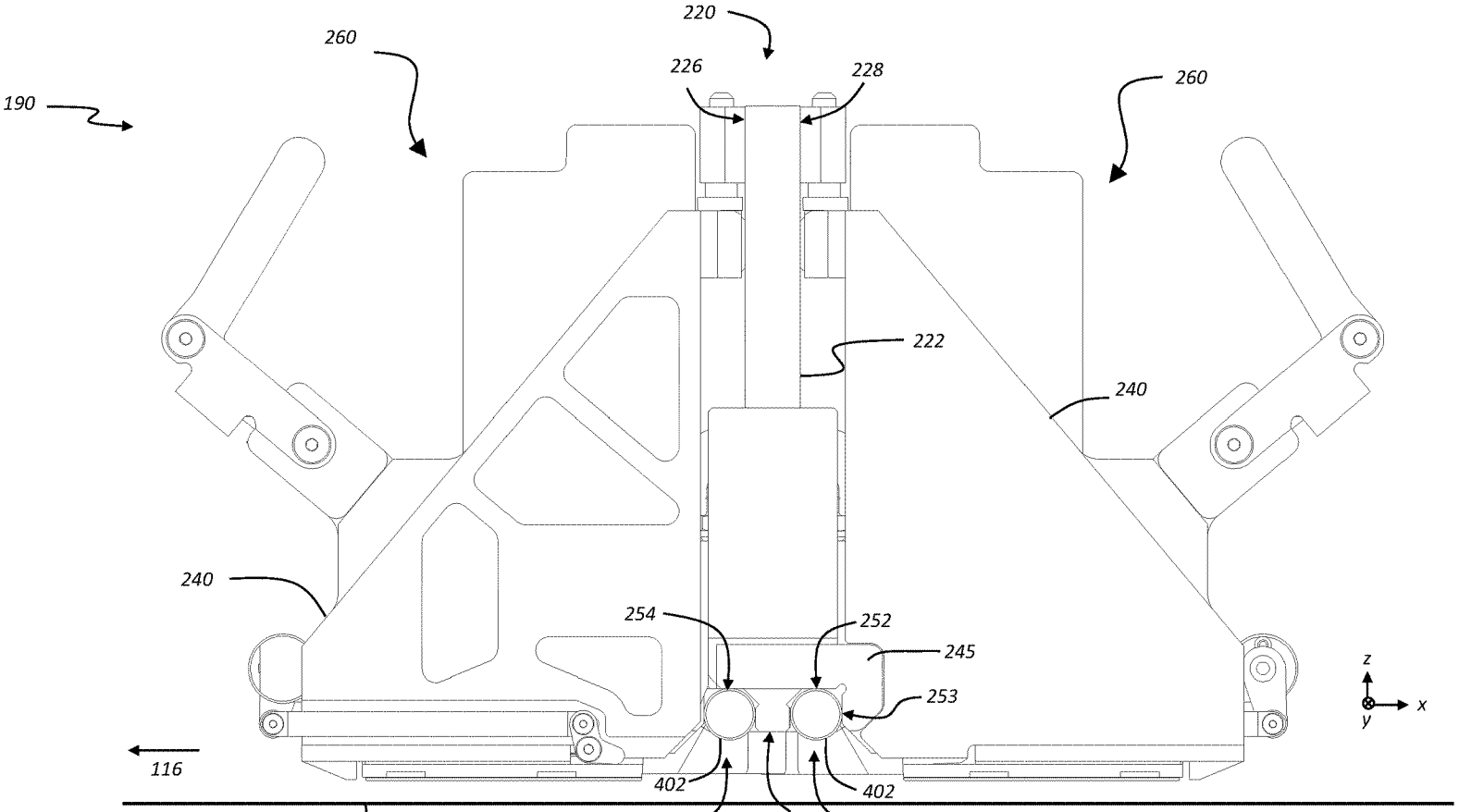
FIG. 24 shows a cross-sectional view of an exemplary printhead assembly according to an alternate embodiment.

FIG. 24 illustrates an alternate embodiment where one of the alignment tabs 245 of the mounting assembly 240 has been extended so that it makes contact with rod segments 402 from both the upstream set 406 and the downstream set 408. Contact with the second rod segment 402 provides the required constraint on rotation about the y-axis for the mounting assembly 240. In this embodiment, the eleventh alignment datum 254 is located on the extended alignment tab 245. The corresponding rotational alignment feature associated with the beam 222, which is engaged by the eleventh alignment datum 254, corresponds to a point on the second rod segment 402. In an analogous manner, one of the alignment tabs 204, 205 of the jetting module 200 (see FIG. 8) can be extended so that it makes contact with rod segments 402 from both the upstream set 406 and the downstream set 408 (not visible in FIG. 24). Contact with the second rod segment 402 can provide the required constraint on rotation about the y-axis to the jetting module 200. In this embodiment, the fifth alignment datum 214 is located on the extended alignment tab 204, 205. The corresponding rotational alignment feature associated with the beam 222, which is engaged by the fifth alignment datum 214, corresponds to the second rod segment 402.

The invention has been described in detail with particular reference to certain preferred embodiments thereof, but it will be understood that variations and modifications can be effected within the spirit and scope of the invention.

PARTS LIST

20 printer system
22 image source
24 image processing unit
26 control circuits
27 synchronization device
28 drop forming transducer
30 printhead
32 print medium
34 print medium transport system
35 speed measurement device
36 media transport controller
38 micro-controller
40 ink reservoir
44 ink recycling unit
46 ink pressure regulator
47 ink channel
48 jetting module
49 nozzle plate
50 nozzle
51 heater
52 liquid stream
54 drop
55 drop formation waveform source
57 trajectory
59 breakoff location
60 drop formation waveform
61 charging device
62 charging electrode
62' charging electrode
63 charging electrode waveform source
64 charging electrode waveform
66 printing drop
68 non-printing drop
69 drop selection system
70 deflection mechanism
71 deflection electrode
72 ink catcher
74 catcher face
76 ink film
78 liquid channel
79 lower plate
80 charging electrode waveform 64 period
82 first voltage state
84 second voltage state
86 non-print trajectory
88 print dot
92-1 drop formation waveform
92-2 drop formation waveform
92-3 drop formation waveform
94-1 drop formation waveform
94-2 drop formation waveform
94-3 drop formation waveform
94-4 drop formation waveform
96 period
98 pulse
100 period
102 pulse
104-1 large drop
104-2 large drop
104-3 large drop
106-1 small drop
106-2 small drop
106-3 small drop
106-4 small drop
108 phase shift
112 printhead assembly
116 in-track direction
118 cross-track direction
132 printing region
134 overlap region
136 centerline
138 nozzle array spacing
190 printhead assembly
200 jetting module
201 fillet
202 nozzle array
203 endmill
204 alignment tab
205 alignment tab
206 notch
207 face
208 face
209 protrusion
210 alignment datum
211 alignment datum
212 alignment datum
213 alignment datum
214 alignment datum
215 alignment datum
216 fluid connections
217 electrical connections
220 rail assembly
222 beam
223 notch
224 rod
225 rotational alignment feature
226 downstream side
228 upstream side
229 mounting bracket
238 upper surface
240 mounting assembly
242 frame
244 alignment tab
245 alignment tab
250 alignment datum
251 alignment datum
252 alignment datum
253 alignment datum
254 alignment datum
255 alignment datum
256 rotational alignment feature
260 printhead module
300 jetting module clamping mechanism
302 handle
304 spring plunger
310 mounting assembly clamping mechanism
312 bolt
314 bolt hole
316 threaded hole
318 threaded hole
320 cross-track force mechanism
350 slot
352 shutter mechanism
356 shutter blade
368 air guide
371 motor
372 shaft

373 lever
377 bar
380 region
382 region
400 air flow duct
402 rod segment
403 gap
404 print-medium-facing side
406 upstream set
408 downstream set
410 upstream edge
412 downstream edge
414 upper portion
416 lower portion
418 spring-biased stop
419 disk springs
420 shoulder bolt
422 axis
423 axis
424 port
426 pocket
430 flow restrictor
432 portion
434 side edge
436 narrowing
438 swath
440 print band
442 upstream printhead pixel
444 downstream printhead pixel
AA cut-line
BB cut-line
CC cut-line
DD cut-line
EE cut-line

The invention claimed is:

1. A modular inkjet printhead assembly including a plurality of jetting modules for printing on a print medium traveling along a media path from upstream to downstream, comprising:

a rail assembly spanning a print zone on the print medium in the cross-track direction, the rail assembly including:

a beam having an upstream side, a downstream side and a print-medium-facing side that faces the print medium, wherein the upstream side and the print-medium-facing side intersect along an upstream edge and the downstream side and the print-medium-facing side intersect along a downstream edge;

an upstream set of rod segments having collinear axes attached to the beam in proximity to the upstream edge; and a downstream set of rod segments having collinear axes attached to the beam in proximity to the downstream edge, wherein the axes of the upstream set of rod segments are parallel to the axes of the downstream set of rod segments;

a plurality of printhead modules, each printhead module including a corresponding jetting module, wherein each jetting module includes:

an array of nozzles extending in a cross-track direction;

a first alignment tab having a first alignment datum and a second alignment datum;

a second alignment tab having a third alignment datum and a fourth alignment datum, the second alignment tab being spaced apart from the first alignment tab in the cross-track direction;

a rotational alignment feature including a fifth alignment datum; and a cross-track alignment feature including a sixth alignment datum;

a jetting module clamping mechanism for each jetting module for applying a force to the associated jetting module that causes the first alignment datum, the second alignment datum, the third alignment datum and the fourth alignment datum of the associated jetting module to engage with a corresponding rod segment and causes the fifth alignment datum of the associated jetting module to engage with a corresponding rotational alignment feature associated with the beam; and a jetting module cross-track force mechanism for each jetting module for applying a cross-track force to the associated jetting module that causes the sixth alignment datum of the associated jetting module to engage with a corresponding cross-track alignment feature associated with the beam;

wherein each jetting module is adapted to engage with the rail assembly, wherein at least one of the jetting modules engages with the rail assembly on the upstream side of the beam such that the associated first alignment datum, second alignment datum, third alignment datum and fourth alignment datum engage with the upstream set of rod segments, and wherein at least one of the jetting modules engages with the rail assembly on the downstream side of the beam such that the associated first alignment datum, second alignment datum, third alignment datum and fourth alignment datum engage with the downstream set of rod segments.

2. The modular inkjet printhead assembly of claim 1, wherein the first and second alignment tabs each include a notch having two faces, the first alignment datum and the second alignment datum corresponding to locations on the faces of the notch in the first alignment tab that contact the corresponding rod segment, and the third alignment datum and the fourth alignment datum corresponding to locations on the faces of the notch in the second alignment tab that contact the corresponding rod segment.

3. The modular inkjet printhead assembly of claim 2, wherein the notches are v-shaped.

4. The modular inkjet printhead assembly of claim 1, wherein the sixth alignment datum is a feature on the first alignment tab or the second alignment tab.

5. The modular inkjet printhead assembly of claim 4, wherein the sixth alignment datum is a side face of the first alignment tab or the second alignment tab, and wherein the cross-track alignment feature is a side face of a corresponding notch in the beam.

6. The modular inkjet printhead assembly of claim 1, wherein the printhead module further includes a mounting assembly mounted to the rail assembly, and wherein the jetting module clamping mechanism is a component of the mounting assembly.

7. The modular inkjet printhead assembly of claim 6, wherein the mounting assembly includes:

a third alignment tab having a seventh alignment datum and an eighth alignment datum;

a fourth alignment tab having a ninth alignment datum and a tenth alignment datum, the fourth alignment tab being spaced apart from the third alignment tab in the cross-track direction; and a rotational alignment feature including an eleventh alignment datum;

and further including a mounting assembly clamping mechanism for applying a force to the mounting assembly that causes the seventh alignment datum, eighth alignment datum, ninth alignment datum, tenth alignment datum and eleventh alignment datum of the mounting assembly to engage with corresponding alignment features on the rail assembly.

8. The modular inkjet printhead assembly of claim 6, wherein the rotational alignment feature associated with the beam that engages with the fifth alignment datum of the associated jetting module is a feature of the mounting assembly having a predefined position relative to the beam.

9. The modular inkjet printhead assembly of claim 6, wherein the printhead module includes an ink catcher for catching non-printing drops of ink ejected from the array of nozzles, the ink catcher being mounted to the mounting assembly.

10. The modular inkjet printhead assembly of claim 9, wherein drops of ink ejected from the array of nozzles pass through a slot before they impinge on the print medium, and wherein the printhead module includes a repositionable shutter blade that can be positioned to block drops of ink from passing through the slot and divert the ink into the ink catcher, the repositionable shutter blade being mounted to the mounting assembly.

11. The modular inkjet printhead assembly of claim 9, wherein the ink catcher is positioned upstream of the array of nozzles for jetting modules engaging with the rail assembly on the upstream side of the rail assembly, and the ink catcher is positioned downstream of the array of nozzles for jetting modules engaging with the rail assembly on the downstream side of the rail assembly.

12. The modular inkjet printhead assembly of claim 6, wherein the printhead module includes a charging module for applying a charge to drops of ink ejected from the array of nozzles, the charging module being mounted to the mounting assembly.

13. The modular inkjet printhead assembly of claim 6, wherein the mounting assembly includes a mounting assembly cross-track alignment feature including a twelfth alignment datum, and further including a mounting assembly cross-track force mechanism for applying a cross-track force to the mounting assembly that causes the twelfth alignment datum to engage with a corresponding cross-track alignment feature associated with the beam.

14. The modular inkjet printhead assembly of claim 1, wherein the rod segments have a cylindrical shape around at least a portion of their circumference.

15. The modular inkjet printhead assembly of claim 1, wherein the jetting module clamping mechanism includes a spring-loaded toggle clamp that can be operated by a human operator to apply the force to the associated jetting module.

16. The modular inkjet printhead assembly of claim 1, wherein the jetting module cross-track force mechanism is a spring mechanism that applies the cross-track force to the associated jetting module.

17. The modular inkjet printhead assembly of claim 1, wherein the first tab is located in proximity to a first end of the jetting module, and the second tab is located in proximity to an opposing second end of the jetting module.

18. The modular inkjet printhead assembly of claim 1, wherein each printhead module further includes an air flow duct positioned to provide a flow of air substantially parallel to drop trajectories of ink drops ejected from the array of nozzles.

19. The modular inkjet printhead assembly of claim 18, wherein the beam includes recessed pockets formed in the upstream and downstream sides, the recessed pockets being aligned with the locations of the printhead modules, wherein at least a portion of each air flow duct is positioned within a corresponding recessed pocket.

20. The modular inkjet printhead assembly of claim 19, wherein each recessed pocket is positioned in a gap between adjacent rod segments.

21. The modular inkjet printhead assembly of claim 18, wherein the air flow ducts are mounted to the rail assembly.

22. The modular inkjet printhead assembly of claim 18, wherein at least one flow restrictor is positioned within each air flow duct.

23. The modular inkjet printhead assembly of claim 1, wherein the upstream set of rod segments consists of a single rod segment and the downstream set of rod segments consists of a single rod segment.

24. The modular inkjet printhead assembly of claim 1, wherein the upstream set of rod segments includes a plurality of rod segments and the downstream set of rod segments includes a plurality of rod segments.

25. The modular inkjet printhead assembly of claim 1, wherein each jetting module engages with the rail assembly at a different cross-track position.

* * * * *